US012098567B2

(12) United States Patent
Baltz, Jr. et al.

(10) Patent No.: US 12,098,567 B2
(45) Date of Patent: Sep. 24, 2024

(54) FENCING BRACKET

(71) Applicant: Alabama Metal Industries Corporation, Birmingham, AL (US)

(72) Inventors: Gary George Baltz, Jr., Mountain Brook, AL (US); Bryan Millican, Trussville, AL (US); Markus Erbeldinger, Pittsburgh, PA (US)

(73) Assignee: Alabama Metal Industries Corporation, Birmingham, AL (US)

( * ) Notice: Subject to any disclaimer, the term of this patent is extended or adjusted under 35 U.S.C. 154(b) by 666 days.

(21) Appl. No.: 17/302,272

(22) Filed: Apr. 29, 2021

(65) Prior Publication Data

US 2021/0340789 A1 Nov. 4, 2021

Related U.S. Application Data

(60) Provisional application No. 63/110,416, filed on Nov. 6, 2020, provisional application No. 63/017,484, filed on Apr. 29, 2020.

(51) Int. Cl.
*E04H 17/14* (2006.01)

(52) U.S. Cl.
CPC ..... *E04H 17/1452* (2021.01); *E04H 17/1473* (2021.01)

(58) Field of Classification Search
CPC ..... E04H 17/1447; E04H 17/1448; E04H 17/1473; E04H 17/1488
(Continued)

(56) References Cited

U.S. PATENT DOCUMENTS 2,856,215 A 10/1958 Schlosser
3,022,044 A 2/1962 Gugino
(Continued)

FOREIGN PATENT DOCUMENTS

DE 3311088 A1 9/1984
DE 3925052 A1 2/1991
(Continued)

OTHER PUBLICATIONS

"WireWorks Anti-Climb." Ameristarfence, Apr. 16, 2013.http://sweets.construction.com/swts_content_files/1766/571005.pdf. Date Accessed: Apr. 18, 2019(Year: 2013).
(Continued)

*Primary Examiner* — Michael P Ferguson
*Assistant Examiner* — Zachary A Hall
(74) *Attorney, Agent, or Firm* — HONIGMAN LLP

(57) ABSTRACT

A fencing bracket having a box structure having opposing left and right sidewalls extending from opposing longitudinal ends forming a U-shaped cross-section, and a return support flange disposed at a lower edge thereof, wherein the left and the right sidewall have a pair of aligned cross beam openings and a first and second opening respectively. The fencing bracket includes a strap having a first fiat portion having a third opening, a middle portion (that is either rounded or rectangular), and a second flat portion having a fourth opening, the middle portion is between the first flat portion and the second flat portion. The first opening is aligned with the third opening and the second opening is aligned with the fourth opening, and a fastener passes through the first, second, third and fourth openings and is retained via another fastener at either the third or fourth opening.

24 Claims, 27 Drawing Sheets

(58) Field of Classification Search
USPC ..... 256/26, 65.01, 68, 65.04, 65.06, 65.03; 248/218.4, 219.4
See application file for complete search history.

(56) References Cited

U.S. PATENT DOCUMENTS

| | | | | |
|---|---|---|---|---|
| 3,092,407 | A * | 6/1963 | Blonder | F16B 2/08 256/65.05 |
| 3,468,430 | A | 9/1969 | Lawman | |
| 3,522,960 | A * | 8/1970 | Moore | E04H 17/1413 256/65.01 |
| 3,734,467 | A | 5/1973 | Weeden | |
| 3,820,909 | A * | 6/1974 | Schindler | F16B 7/04 403/205 |
| 3,902,703 | A | 9/1975 | Bouye | |
| 3,955,801 | A | 5/1976 | Soriero, Jr. | |
| 4,140,298 | A | 2/1979 | Coleman, Jr. | |
| 4,542,885 | A | 9/1985 | Rossiter | |
| 4,609,185 | A | 9/1986 | Prater | |
| 4,899,991 | A | 2/1990 | Brunkan | |
| 5,046,705 | A * | 9/1991 | Williams | E01F 7/02 256/70 |
| 5,161,783 | A | 11/1992 | German | |
| 5,421,557 | A | 6/1995 | Vise | |
| 5,556,080 | A | 9/1996 | Vise | |
| 5,593,143 | A * | 1/1997 | Ferrarin | E04H 17/08 248/74.1 |
| 6,290,213 | B1 | 9/2001 | Laird | |
| 6,386,519 | B1 | 5/2002 | Priefert | |
| 6,499,725 | B2 | 12/2002 | Meis | |
| 6,802,496 | B1 | 10/2004 | Preta | |
| 6,905,109 | B2 | 6/2005 | Mills | |
| 7,232,114 | B2 | 6/2007 | Platt | |
| 7,789,376 | B2 | 9/2010 | Diamond | |
| 8,631,551 | B1 | 1/2014 | Payne | |
| 8,777,186 | B2 | 7/2014 | Russier | |
| 8,910,925 | B2 | 12/2014 | Payne | |
| 9,115,506 | B2 * | 8/2015 | Hill | E04H 17/1417 |
| 9,234,367 | B2 | 1/2016 | Kopp | |
| 9,347,191 | B2 | 5/2016 | Kemper | |
| 10,221,586 | B2 | 3/2019 | Mayer, Jr. | |
| 10,364,589 | B2 | 7/2019 | Cochrane | |
| 10,570,640 | B2 | 2/2020 | Mayer, Jr. | |
| 10,604,962 | B1 | 3/2020 | Givens et al. | |
| 11,180,928 | B2 | 11/2021 | Mayer, Jr. et al. | |
| 2004/0188667 | A1 | 9/2004 | Ray | |
| 2005/0087733 | A1 | 4/2005 | Weitzel | |
| 2006/0175590 | A1 | 8/2006 | Fumagalli | |
| 2006/0226406 | A1 | 10/2006 | Vise | |
| 2007/0272909 | A1 | 11/2007 | Payne | |
| 2009/0321701 | A1 | 12/2009 | Payne | |
| 2010/0193756 | A1 | 8/2010 | Buckley | |
| 2010/0288989 | A1 | 11/2010 | Williams | |
| 2010/0288992 | A1 | 11/2010 | Gray | |
| 2011/0062404 | A1 | 3/2011 | Shepherd | |
| 2012/0138758 | A1 | 6/2012 | Graber | |
| 2012/0235105 | A1 | 9/2012 | Yasher | |
| 2013/0341580 | A1 | 12/2013 | Bergner et al. | |
| 2014/0353564 | A1 | 12/2014 | Shepherd | |
| 2015/0041742 | A1 | 2/2015 | Xu | |
| 2016/0097217 | A1 | 4/2016 | Loehr | |
| 2016/0108640 | A1 | 4/2016 | Graber | |
| 2017/0096835 | A1 | 4/2017 | Messelis | |
| 2017/0321448 | A1 | 11/2017 | Shepherd | |
| 2020/0149309 | A1 | 5/2020 | Mayer, Jr. | |

FOREIGN PATENT DOCUMENTS

| | | |
|---|---|---|
| GB | 2507864 A | 5/2014 |
| WO | 2014057278 A1 | 4/2014 |

OTHER PUBLICATIONS

"Niles Security Clips Block the Bad Guys." Niles Fence & Security, Jan. 13, 2015, Niles Fence & Security Products, LLC., www.nilesfence.com/blog/new-niles-security-clips-block-the-bad-guys/. Date accessed: Jun. 7, 2019. (Year: 2015).

* cited by examiner

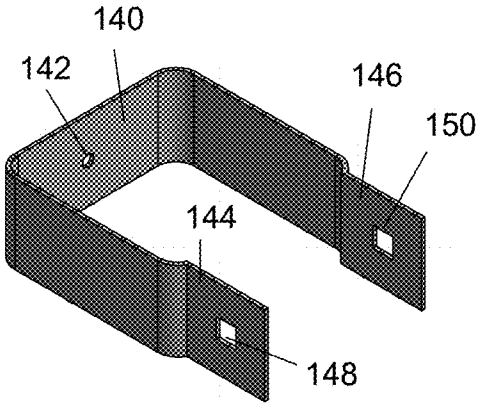
FIG. 14
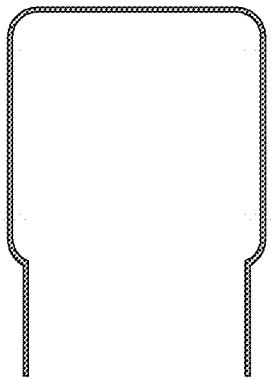
FIG. 15
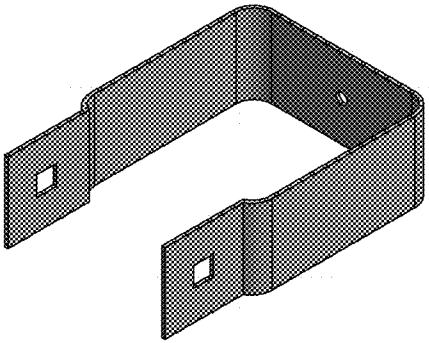
FIG. 16
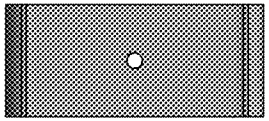
FIG. 17
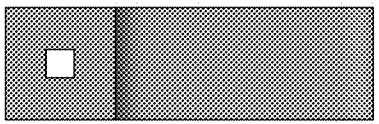
FIG. 18
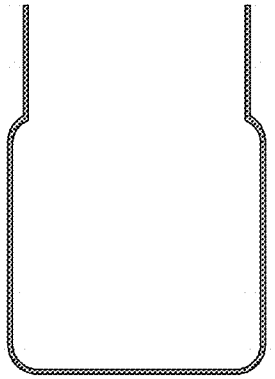
FIG. 19
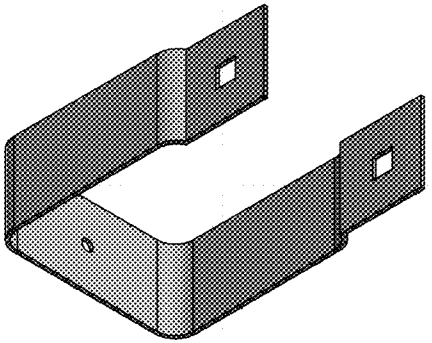
FIG. 20
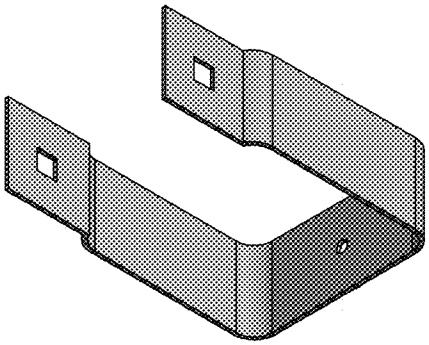
FIG. 21
FIG. 22

FENCING BRACKET

CROSS REFERENCE TO RELATED APPLICATIONS

This application claims the filing benefits of U.S. provisional application Ser. No. 63/017,484, filed Apr. 29, 2020, and U.S. provisional application Ser. No. 63/110,416, filed Nov. 6, 2020, which are hereby incorporated herein by reference in their entireties.

TECHNICAL FIELD

The present disclosure generally relates to a bracket for a fencing system and, more particularly, to brackets for a modular and versatile fencing system.

BACKGROUND

A fence is a structure that encloses an area, typically outdoors. There are many perimeter fencing solutions available in the market. Generally, a fence around a property or area involves installing in the ground a number of posts spaced apart to receive individual connecting rails and fence panels/wires. A fence differs from a wall in that the fence typically does not have a solid foundation along its whole length.

SUMMARY

The fencing assembly of the present disclosure provides a more robust and secure perimeter fencing over known conventional fencing assemblies. Retrofit embodiments described herein allow old fences not providing a required level of security to be retrofitted increasing the level of security. The fencing brackets of the fencing assembly allow for a retrofit to change the look of the fence from chain link to welded wire to an architecturally pleasing secure barrier. Retrofitting allows for a plurality of shapes, for instance, 3-sided, 4-sided or round. There may be a plurality of materials for the posts, rails and fittings, such as, for example, ferrous or non-metallic or non-conductive materials. The fencing assembly and system places the rail and post in compression fit, and allows the rail to adjust relative to the post allowing for changes in grade. A round hole can be cut in the vertical extruded or roll formed post and an extruded rail can be selected from plurality of shapes, for instance, 3-sided, 4-sided or round. The round rail might have a flat side to allow flush mount of panels to rail and allow for threaded fastener.

The fencing assembly includes a retrofit bracket having a box structure with a return support flange that prevents rotation, keeps the strap of the bracket in the correct orientation and allows for use of a light gauge material while better distributing stress loading. The cross beam may be a hollow rail member and may be substantially rectangular or square in cross-section. The fencing assembly also envisions new construction embodiments (as opposed to retrofit embodiments) that provide ease of installation, superior strength and enhanced security.

Thus, the fencing assembly provides brackets for a modular and versatile fencing system based on posts with brackets for accepting cross beams for ease of installation and efficient load distribution. The fencing bracket and assembly and systems and methods may be utilized to retrofit fence panels to existing fence posts, resulting in substantial installation cost savings and improved strength of the fence.

These and other objects, advantages, purposes and features of the present invention will become apparent upon review of the following specification in conjunction with the drawings.

BRIEF DESCRIPTION OF THE DRAWINGS

In the following section, the present disclosure will be described with reference to exemplary embodiments illustrated in the figures, in which:

FIGS. 14-26 are views of another retrofit bracket according to another embodiment of the present disclosure;

DETAILED DESCRIPTION

Figure 1:
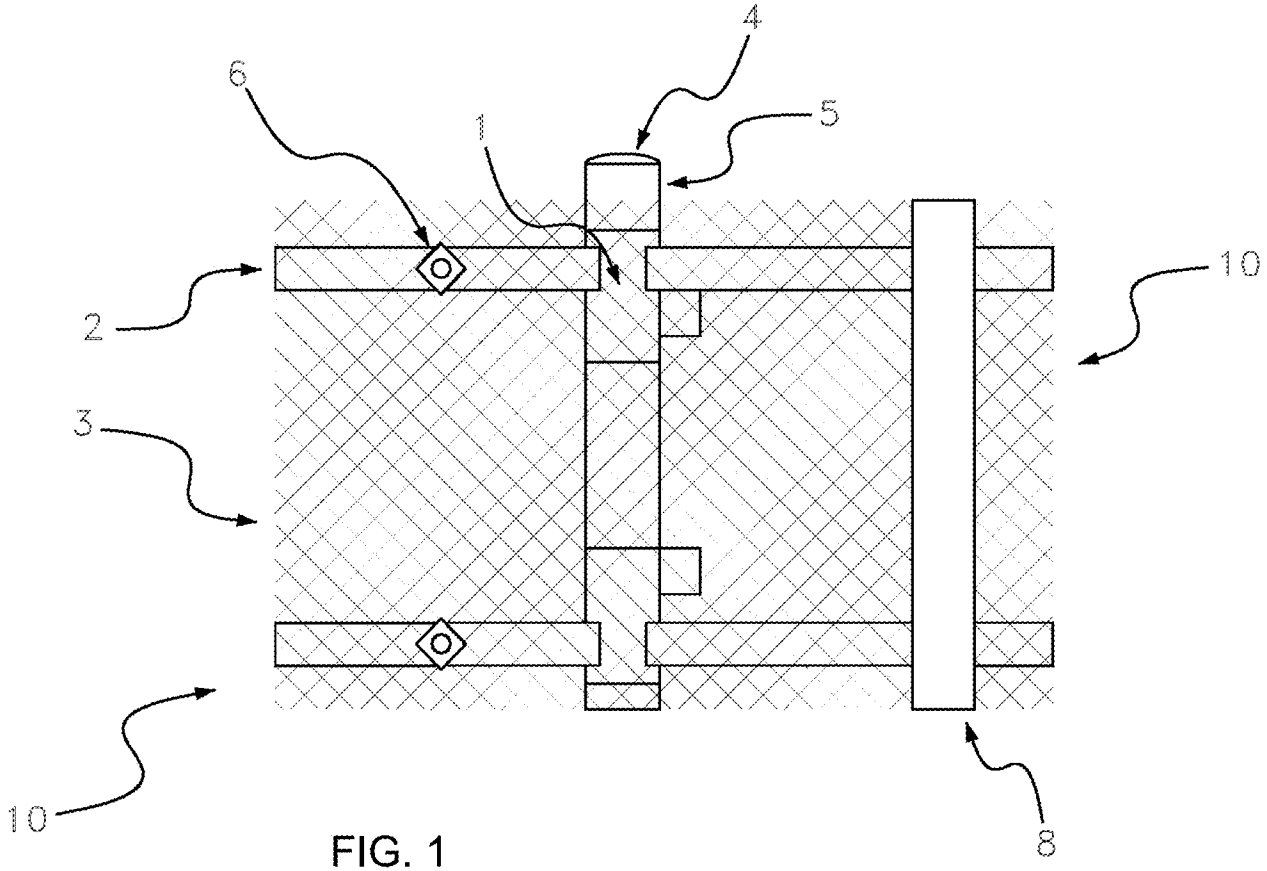
FIG. 1 depicts the environment in which the brackets are utilized according to the present invention.

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other.

Current fencing solutions often offer posts, which may be aesthetically unappealing because posts are integral to a fence system and should integrate with the design instead of sticking out. Furthermore, connecting rails to posts frequently involves cutting longer lengths of rail pipe and then using clamps to secure the rail at its both ends. Clamping fittings to the post to make mechanical connection of the rails is not aesthetic and is time-consuming. Also, if the post has a hole punched through, water can invade, causing rust or freezing and splitting of the post. The rails may also be scuffed up to the point the powder coated finish of the rails is compromised. Additionally, with larger diameter posts, rails joining at posts are not on the same plane as the face of the framework. This can create a wavy appearance looking down the fence line.

The posts in traditional fences also pose a problem as to how to give a finished look to line, corner, end, and gate posts. Lack of proper finishing may expose corners and ends of fence lines with spaces for one to begin cutting or climbing.

The individual pieces of rails used for connecting the posts can reduce the overall strength of the fence against impact. When unwanted breaching occurs, the top rail can become bent, which may compromise the strength of the fence. Furthermore, rails that use sleeves to connect pieces of the rail can physically shift or be forced apart. This not only creates a bad visual appearance, but also reduces the level of security of the barrier. In addition, the use of washers for fittings or clamping in conventional fences requires a large quantity of washers and does not ensure that the strength is continuous throughout the quantity of washers required. Still further, the posts and segmented rails in a traditional fence make it difficult to incorporate impact cables or run electric and optic cables throughout the length of the fence. It is also difficult to incorporate detection devices—such as cameras or monitoring systems—into a traditional fence design.

It is noted that various figures (including component diagrams) shown and discussed herein are for illustrative purpose only, and are not drawn to scale. FIG. 1 shows an exemplary fence system 10 according to one embodiment of the present disclosure. The fence system 10 shown in FIG. 1 may be a portion of a perimeter security system that may be erected surrounding a geographical area. As illustrated, the fence system 10 may include at least two posts 5 (typically multiple posts arranged along the fence line or path), a bracket 1 at each post (such as a bracket at a lower region of a post and another bracket at an upper region of the post), at least one cross beam 2 placed in the cross beam opening of two adjacent brackets (at adjacent posts), and a fence panel 3 attached to the cross beam(s). The fence posts may be from an existing fence having fence panels removed. It is noted that one post 5 is depicted, but one of ordinary skill in the art would understand that there may be an number of similarly depicted posts and two posts are required to support the cross beam(s). The fence panel 3 depicted is a mesh panel attached to the at least one cross beam 2 by a diamond clip with a threaded fastener 6. Because the brackets provide the cross beams continuously along the fence line and not interrupted by the fence posts, the fence panel may comprise a continuous panel that is also not interrupted by the fence posts.

There may also be a diamond clip on the outside of the fence between the fence panel 3 and a fastener that goes through the cross beam 2 and the fence panel 3. The fence may include infill panels, which allow for a plurality of fence styles, e.g., pickets, pales or privacy. Such panels can fit to the inside or outside of a vertical structural member allowing for no post penetrations. The rails are locked to the posts, with little to no vibration. There may also be an attachment plate 8, which is typically used to join adjacent panels to form a fence. The attachment plate 8 is typically placed on top of an outside of adjacent fence panels. The fence panels may be made of any suitable panel material, such as mesh, chain link, picket fence, fabric, standard posts or the like.

Figure 11:
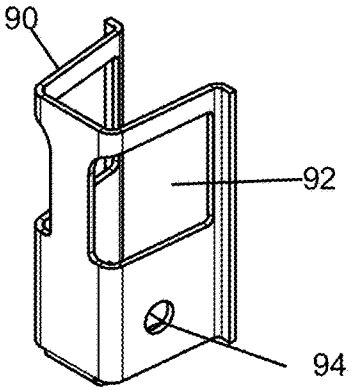
FIG. 11 is a perspective view of the narrow retrofit bracket.
Figure 13:
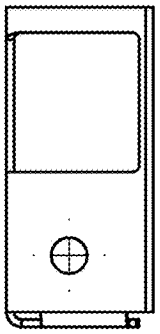
FIG. 13 is a side view of the narrow retrofit bracket.
Figure 10:
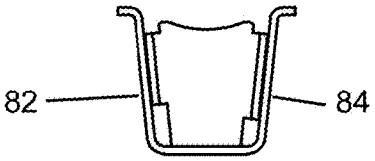
FIG. 10 is a top view of a narrow retrofit bracket according to one embodiment of the present disclosure.
Figure 12:
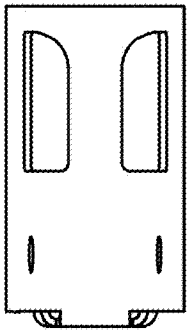
FIG. 12 is a front view of the narrow retrofit bracket.
Figure 23:
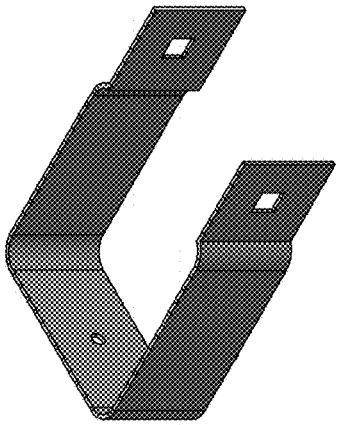
Figure 24:
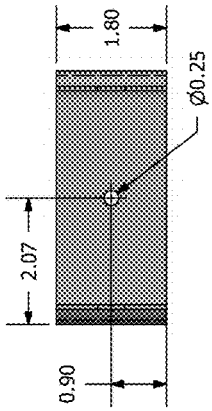
Figure 26:
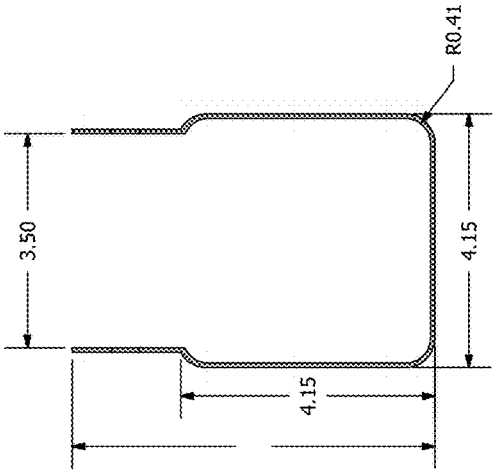
Figure 25:
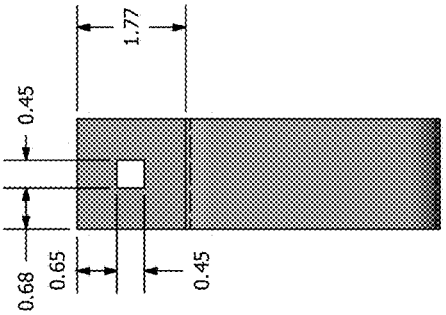
Figure 27:
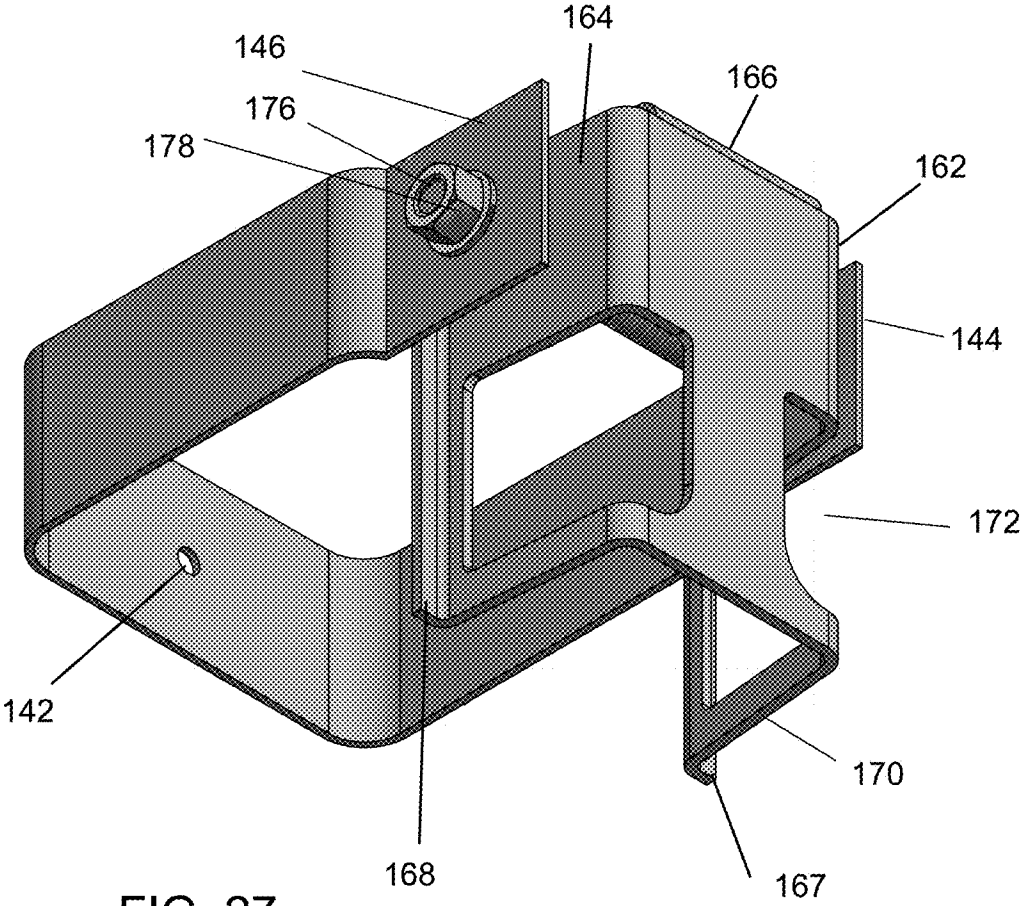
FIGS. 27-29 are views of another retrofit bracket according to another embodiment of the present disclosure.
Figure 28:
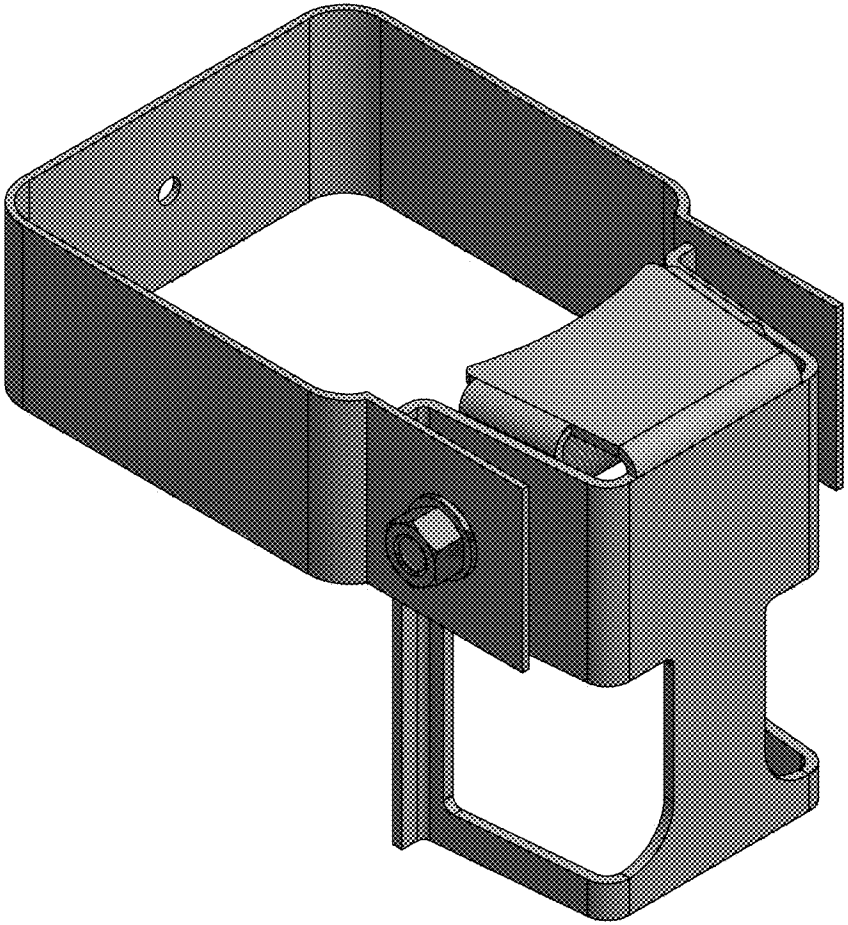
Figure 29:
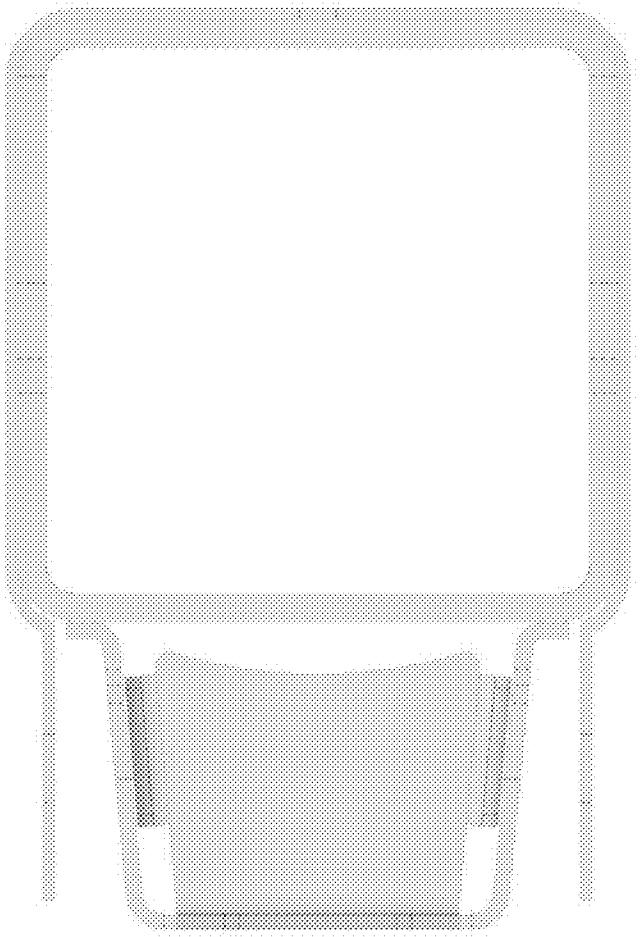
Figure 30:
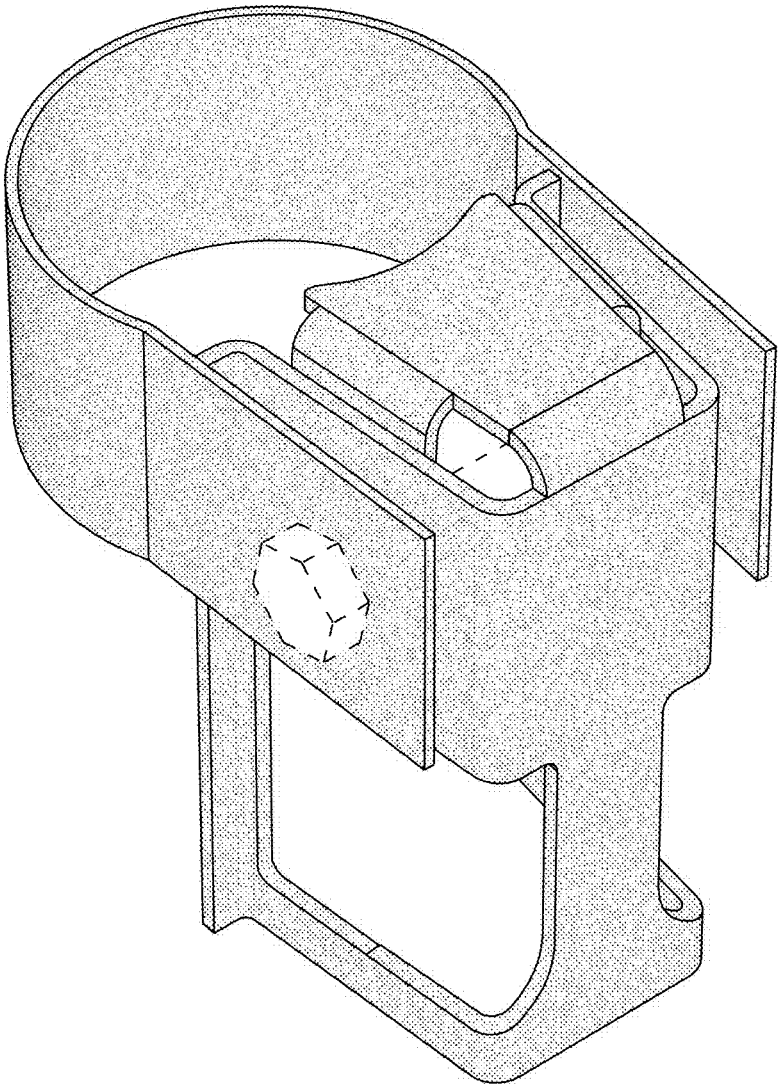
FIGS. 30-38 are views of another retrofit bracket according to another embodiment of the present disclosure.
Figure 31:
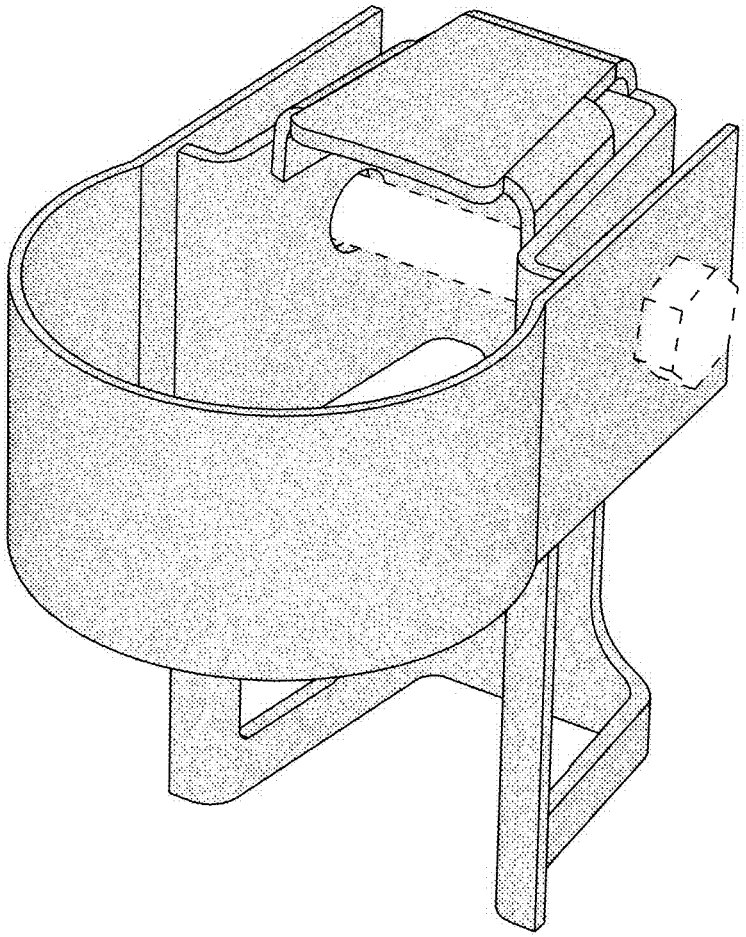

A fencing bracket with a rounded middle portion is depicted in FIGS. 2-13 and 30-38. The embodiment with the rounded middle portion is typically used with a round fence post and the embodiment with the rectangular middle portion (such as shown in FIGS. 14-29 and 39-47) is typically used with a square or rectangular fence post. The bracket comprises a box structure 70 (FIGS. 7-9) and a strap 40 (FIGS. 2-5) retained together via a fastener 76, 78. The box structure 70 comprises a bent elongated plate having a substantially planar central wall 61 having opposing left sidewall 62 and right sidewall 64 extending from opposing longitudinal ends thereof, and a return support flange 66 disposed at a lower edge thereof, the left sidewall 62 having a left side hem 67 disposed along a longitudinal edge thereof, the right sidewall 64 having a right side hem 68 disposed along a longitudinal edge thereof, the left and right side hems each being bent outwardly along each respective sidewall edge forming a U-shaped cross-section. The left sidewall and the right sidewall have a pair of aligned cross beam openings 72, and the opposing left and right sidewalls have a first opening 73 (FIG. 37) and a second opening 74, respectively. The box structure may comprise a wide box structure (as depicted in FIGS. 6-9) or a narrow box structure (as depicted in FIGS. 10-13). The narrow box structure 90 is similar to the wide box structure 70 and includes the first and second sidewalls 82, 84 having first and second openings (the second opening 94 is shown in FIG. 11, with the first opening being through the first sidewall and generally aligned with the second opening) and cross beam openings 92 through the sidewalls. The fencing bracket may utilize aspects shown in U.S. design patent application Ser. No. 29/757,637, filed Nov. 7, 2020, and/or Ser. No. 29/757,535, filed Nov. 6, 2020, and/or Ser. No. 29/757,638, filed Nov. 7, 2020, which are all hereby incorporated herein by reference in their entireties.

Figure 6:
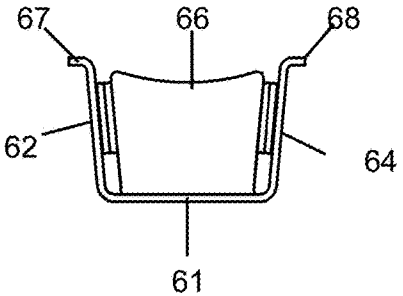
FIG. 6 is a top view of a wide retrofit bracket according to one embodiment of the present disclosure.
Figure 8:
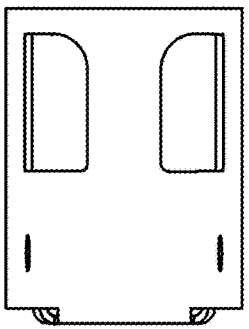
FIG. 8 is a front view of the wide retrofit bracket.

The return support flange 66 may have a rounded edge (as shown in FIG. 6 it may be slightly rounded). The rounded edge is sized to receive a corresponding size fence post, which may be round. It is noted that the first opening is at the same location on the left sidewall as that depicted by the second opening on the right sidewall, but not viewable as being on the unseen portion of FIG. 7 on the left side wall. The strap 40 (FIGS. 2-5) comprises a first flat portion 44 having a third opening 48, a rounded middle portion 41 and a second flat portion 46 having a fourth opening 50, wherein the rounded middle portion 41 is between the first flat portion 44 and the second flat portion 46. There may be a third opening 42 in the rounded middle portion. It is noted that the third opening 48 and the fourth opening 50 may be square, rectangular or circular shaped.

Figure 32:
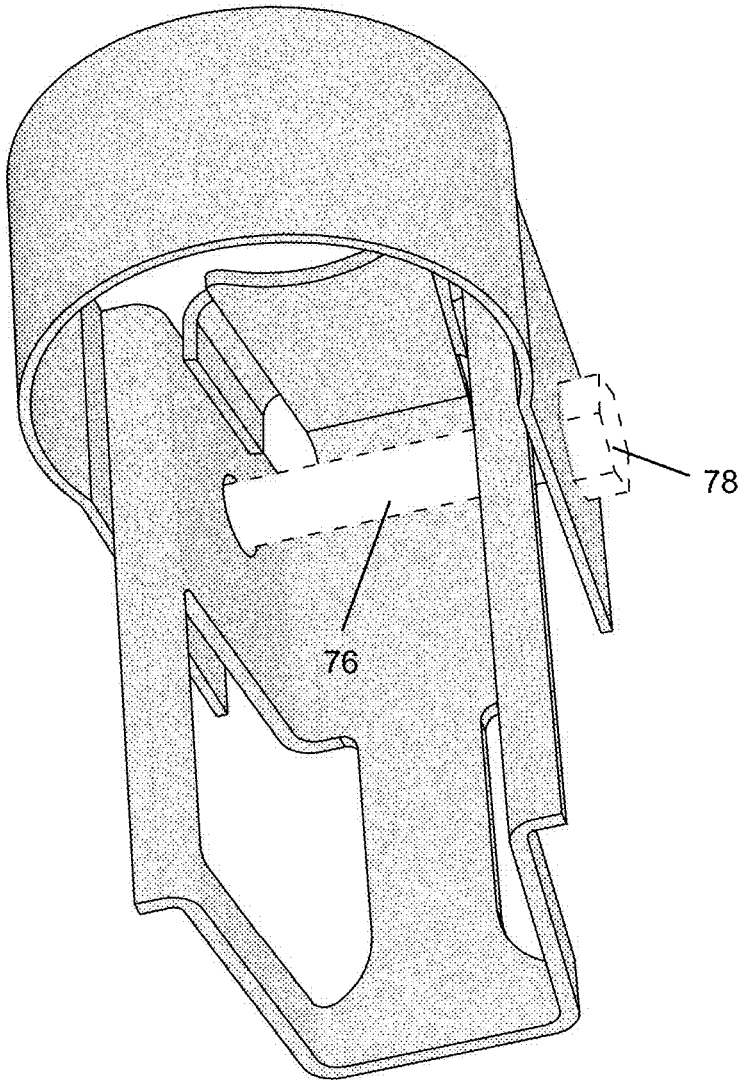
Figure 33:
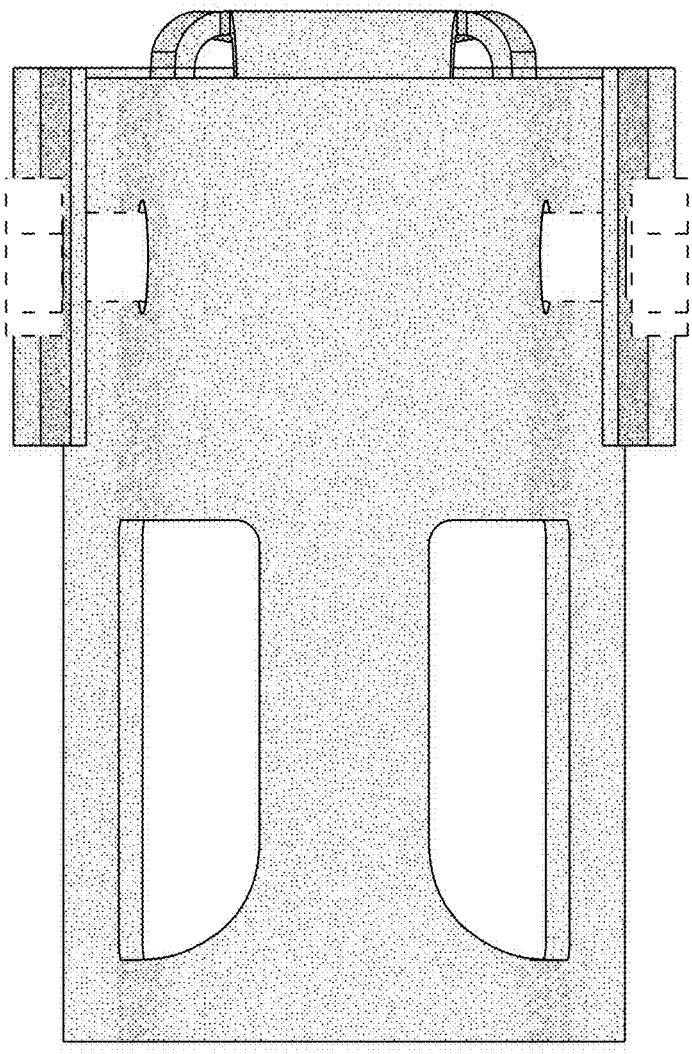
Figure 34:
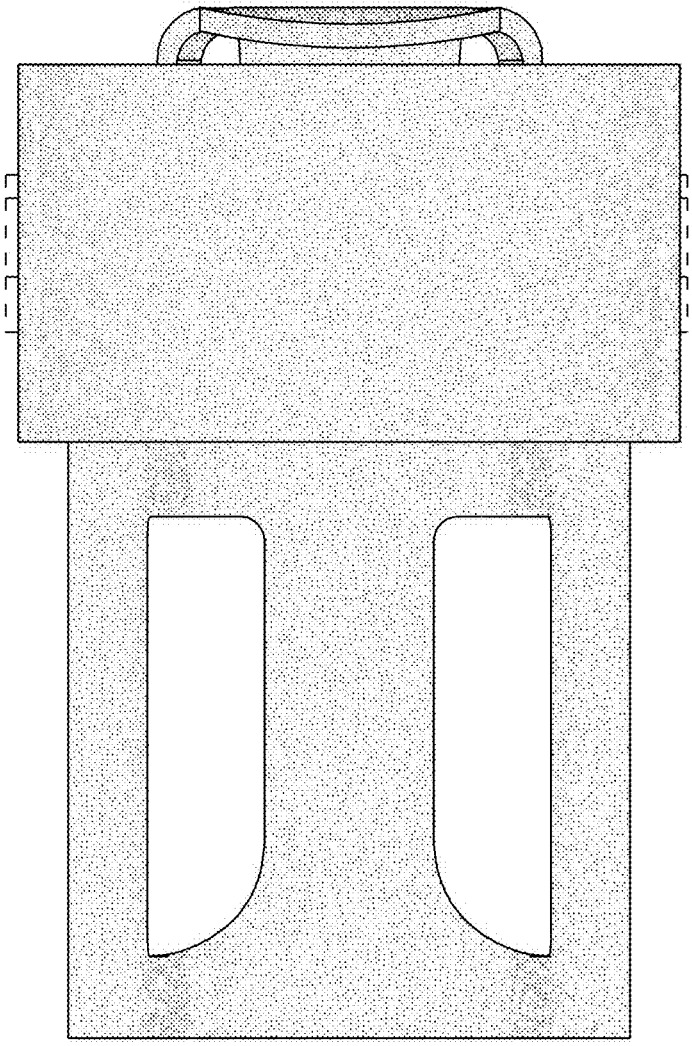
Figure 35:
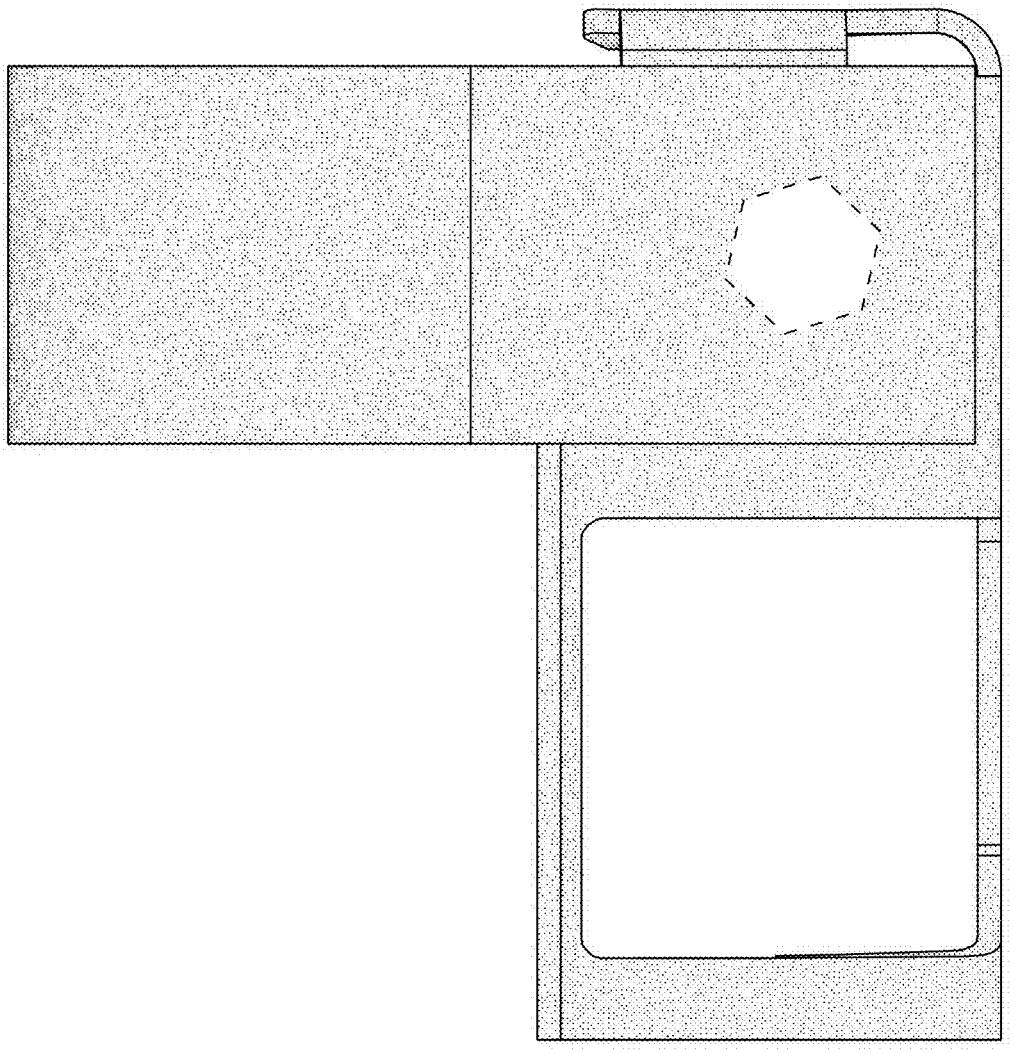
Figure 36:
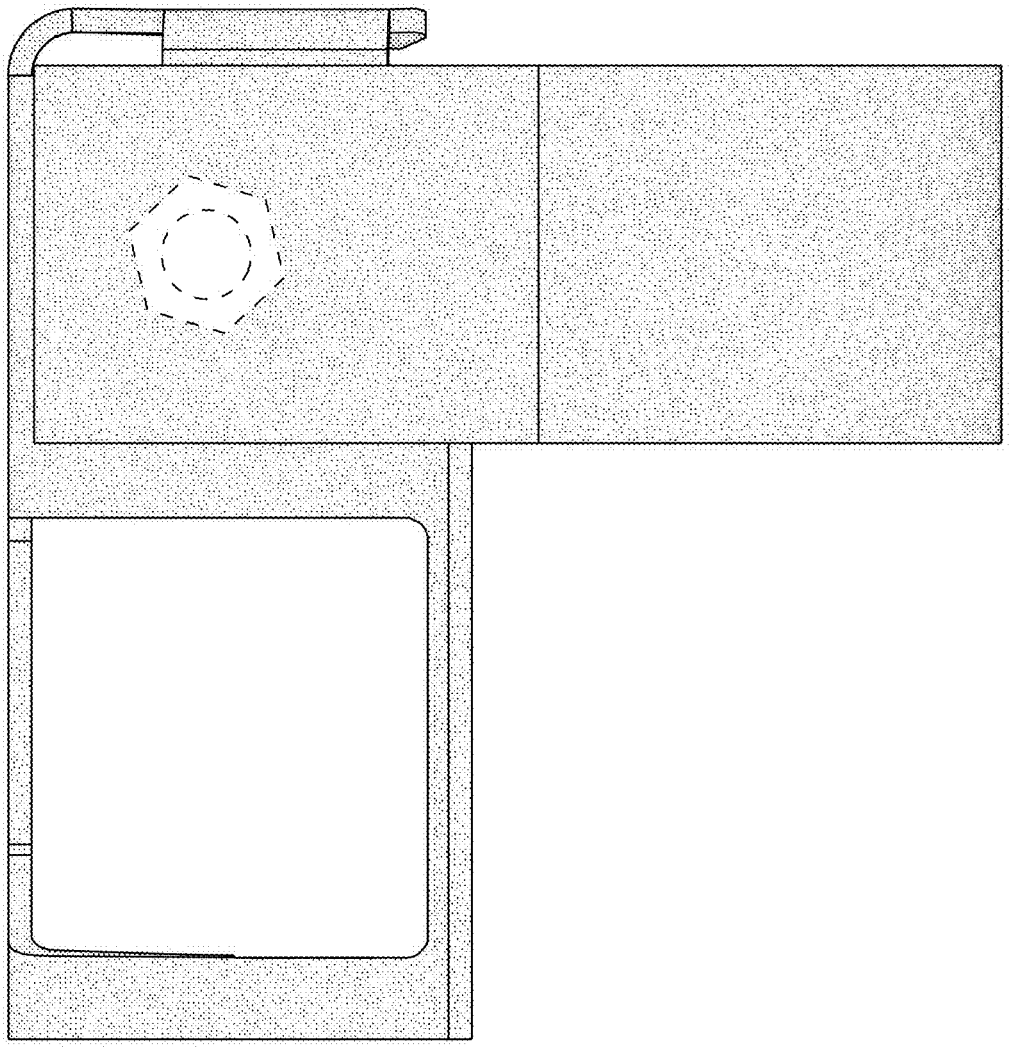
Figure 37:
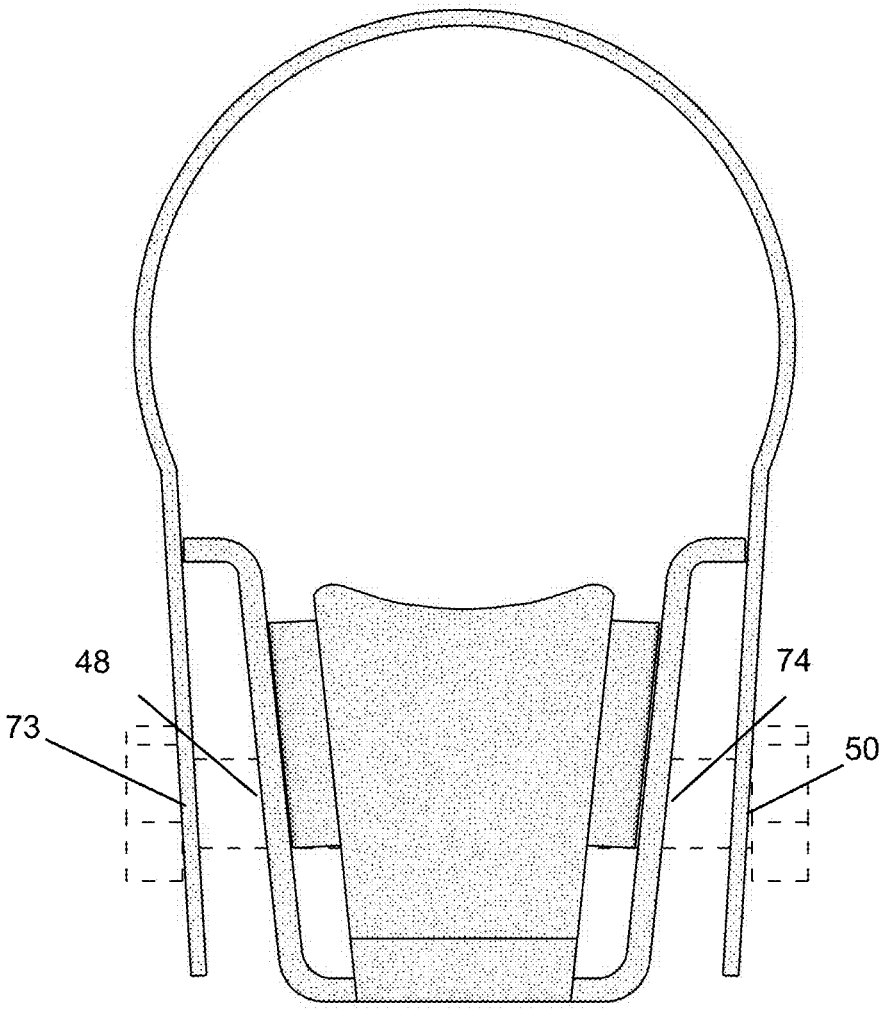
Figure 38:
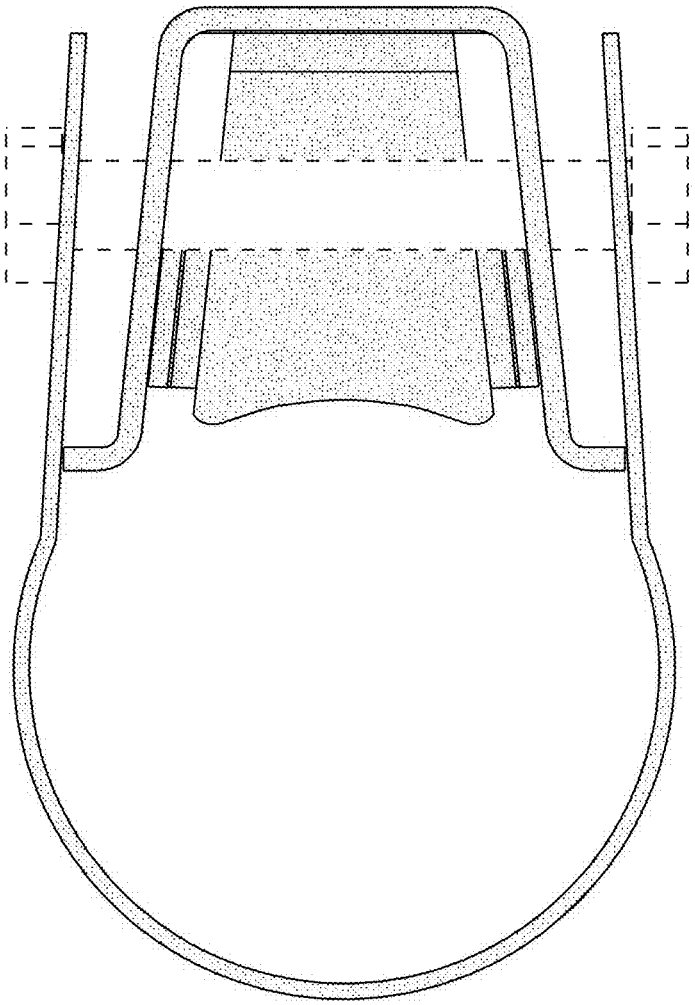
Figure 39:
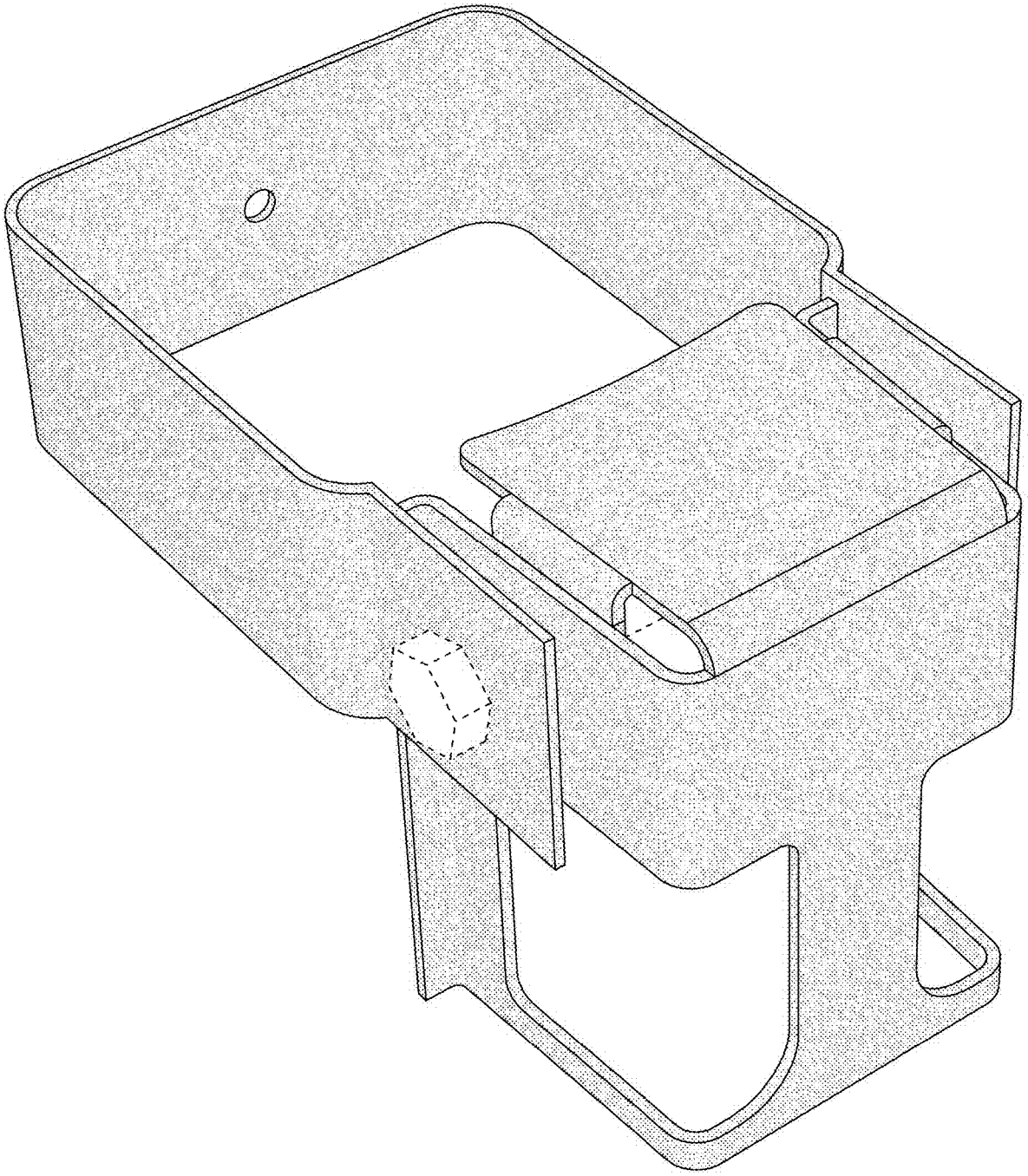
FIGS. 39-47 are views of another retrofit bracket according to another embodiment of the present disclosure.
Figure 40:
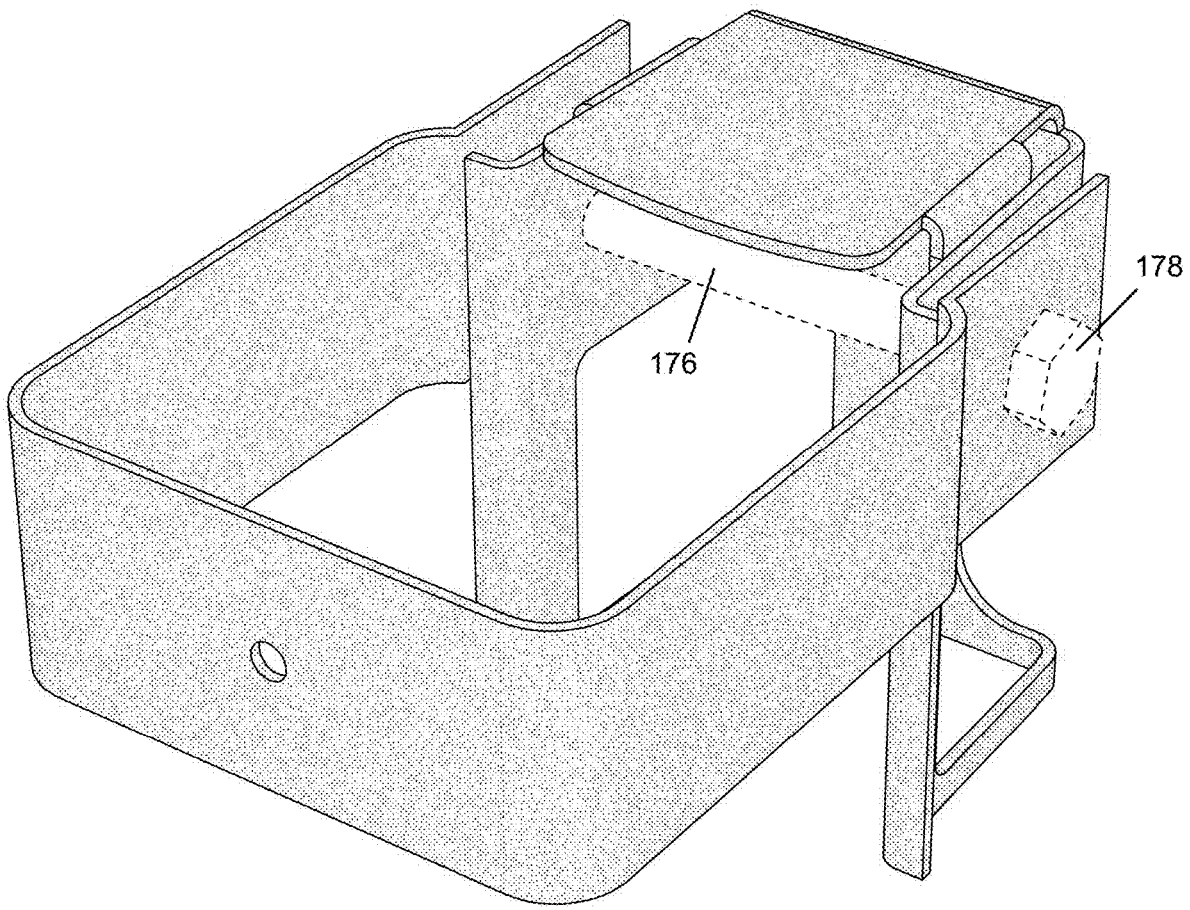
Figure 41:
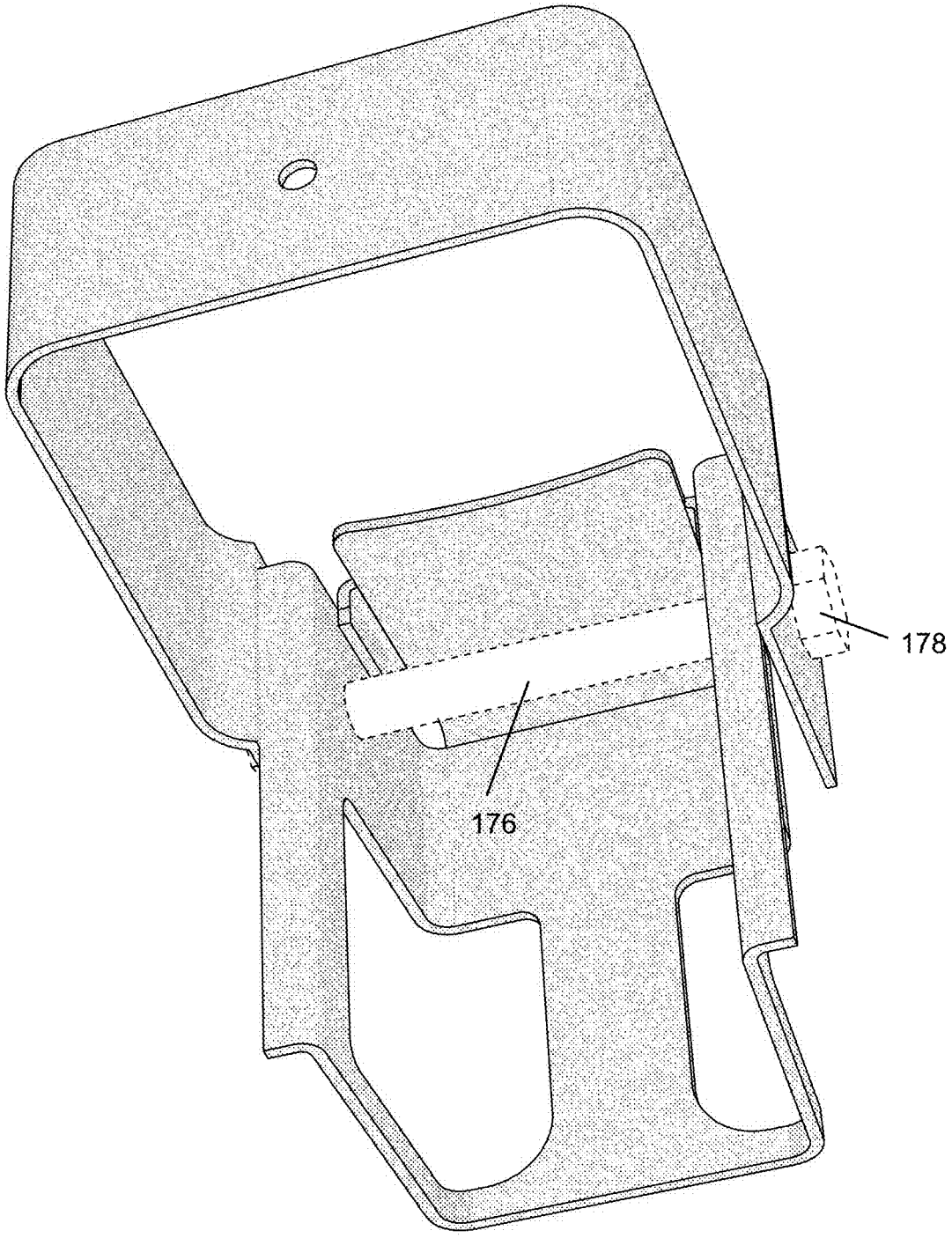
Figure 42:
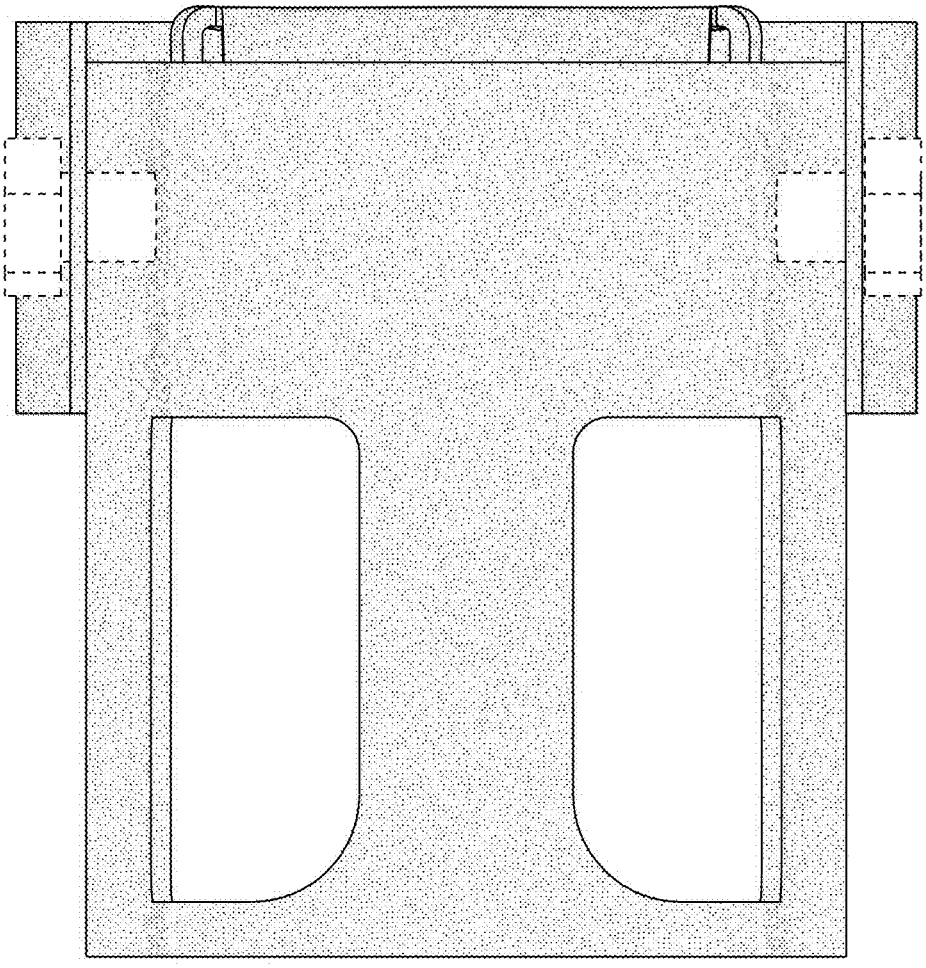
Figure 43:
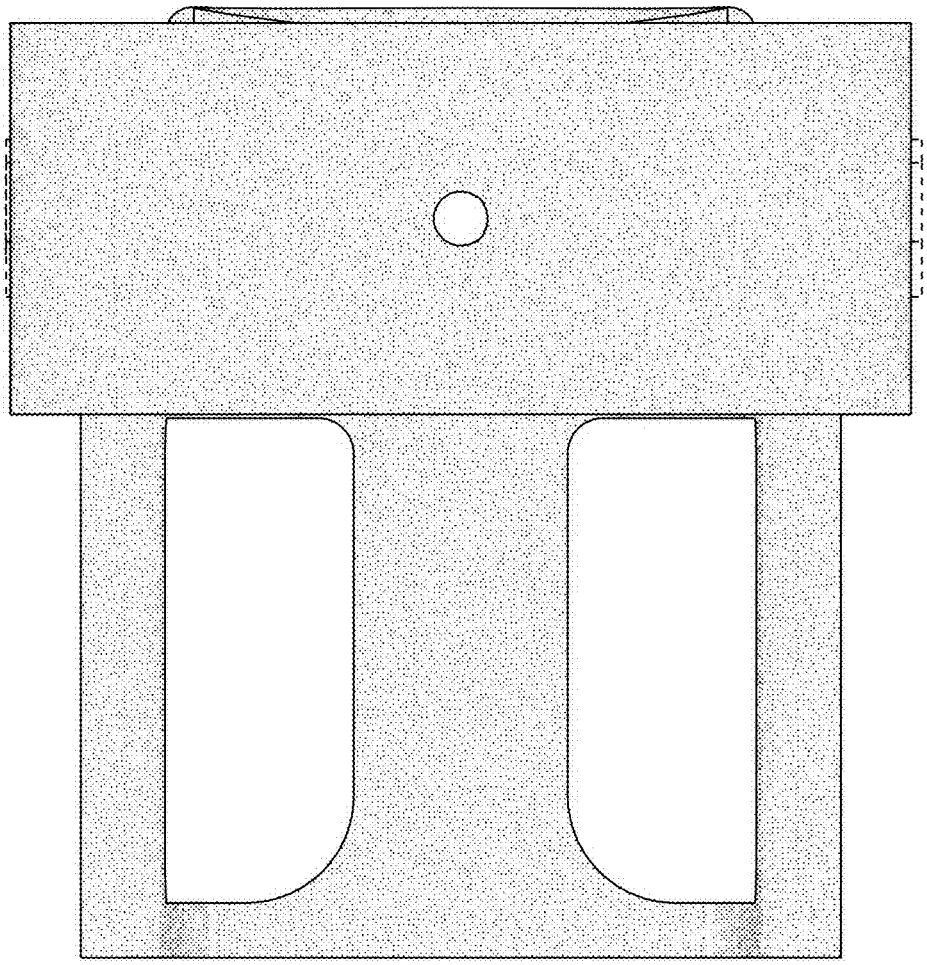
Figure 44:
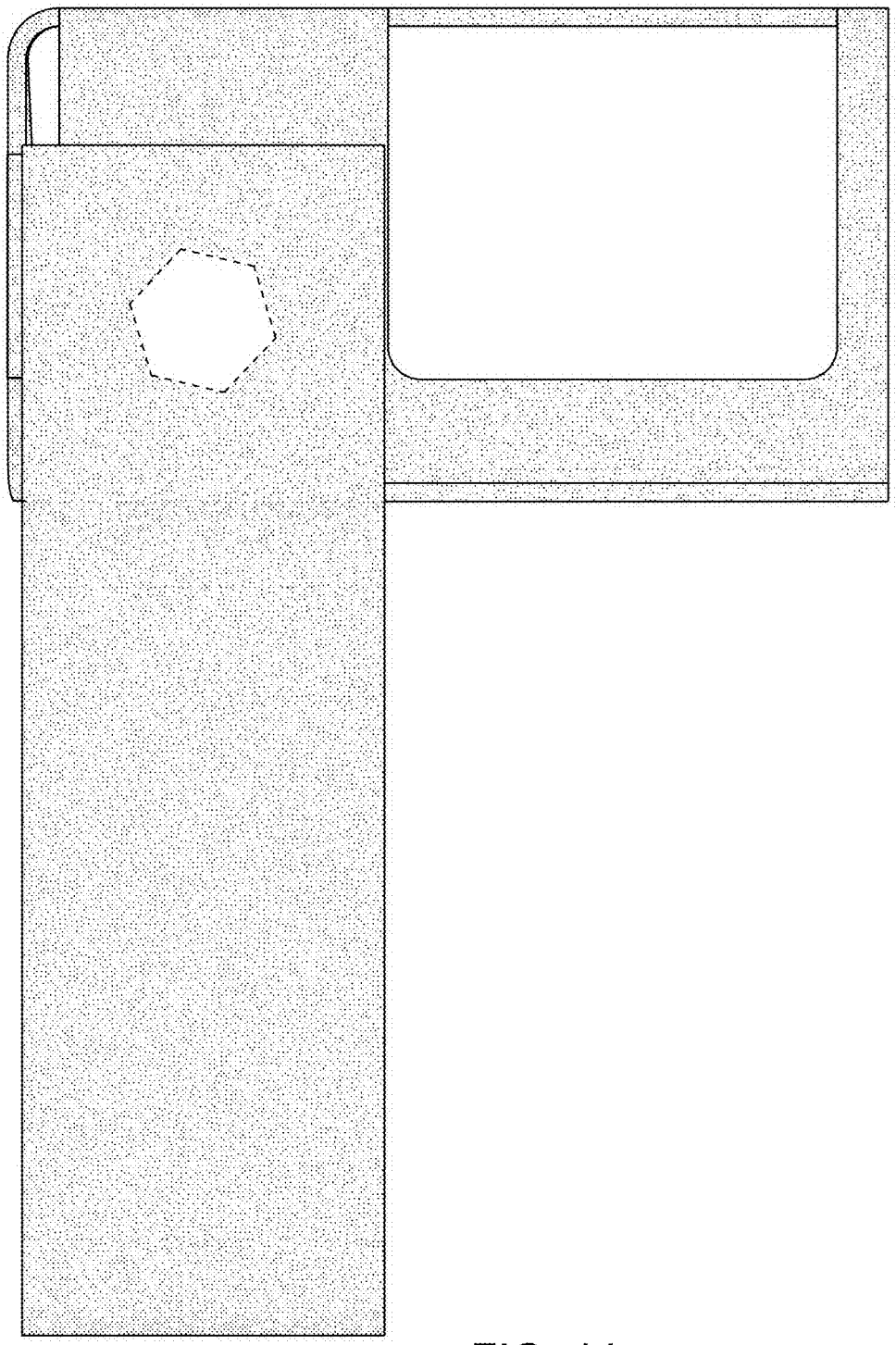
Figure 45:
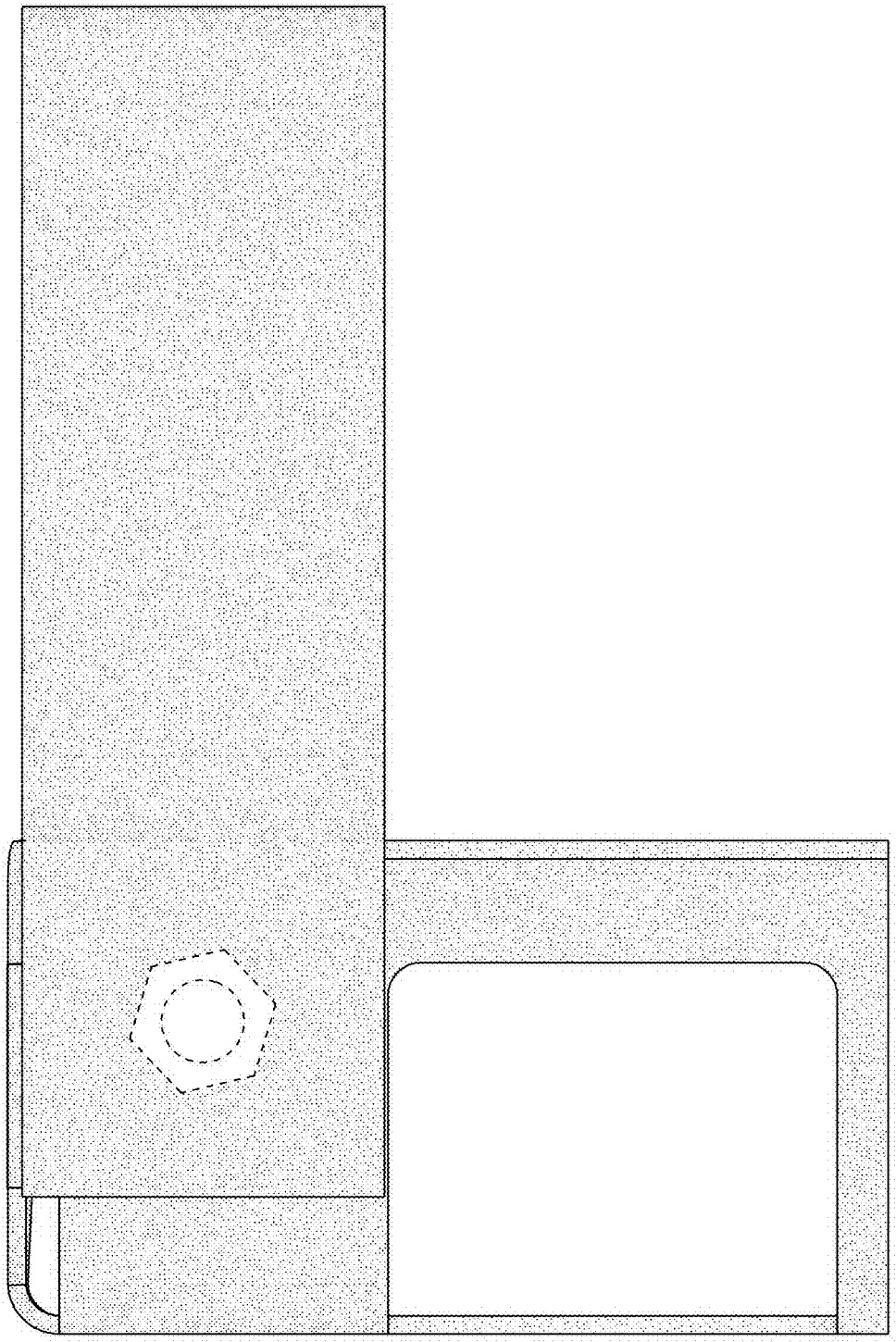
Figure 46:
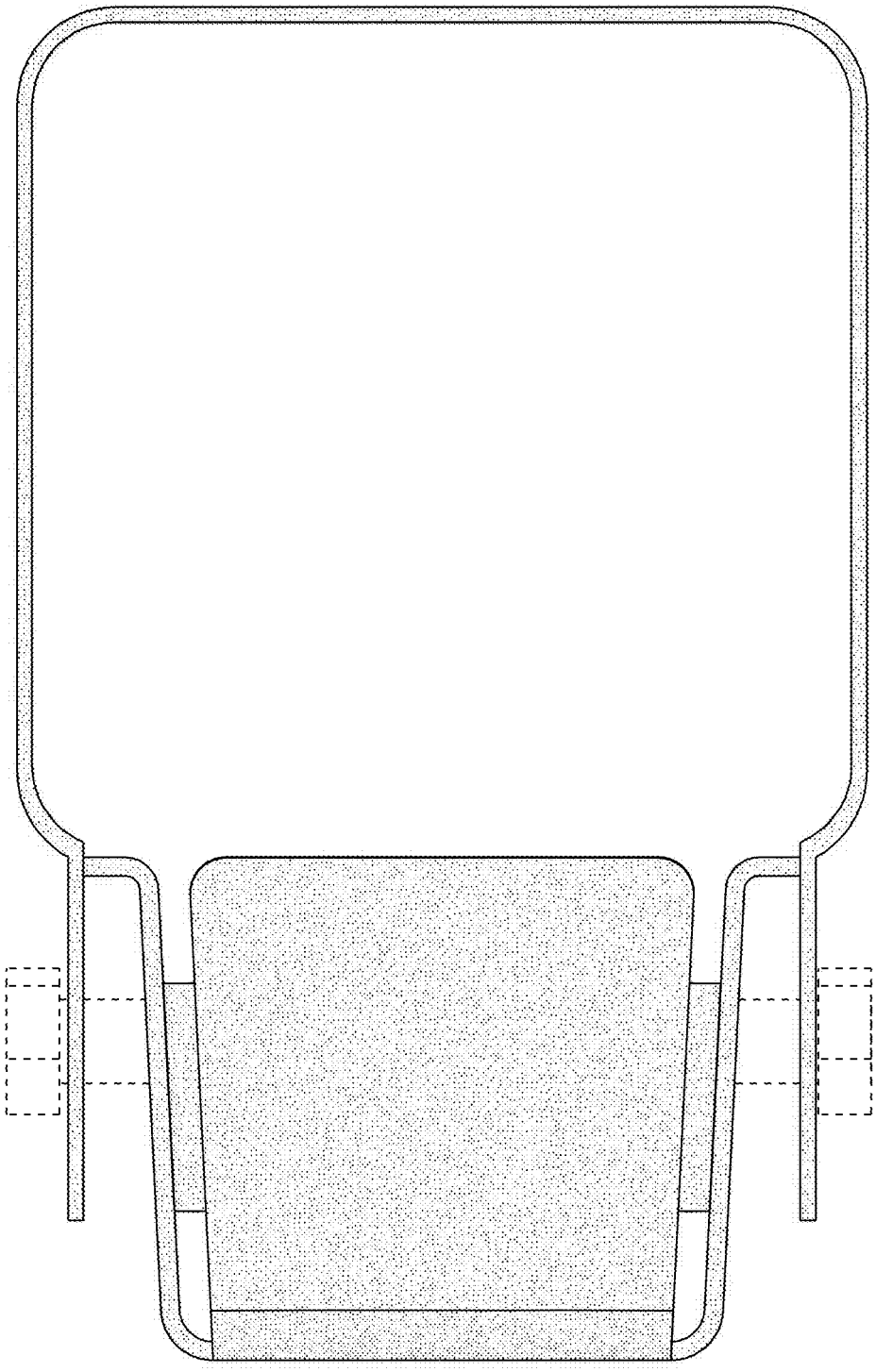
Figure 47:
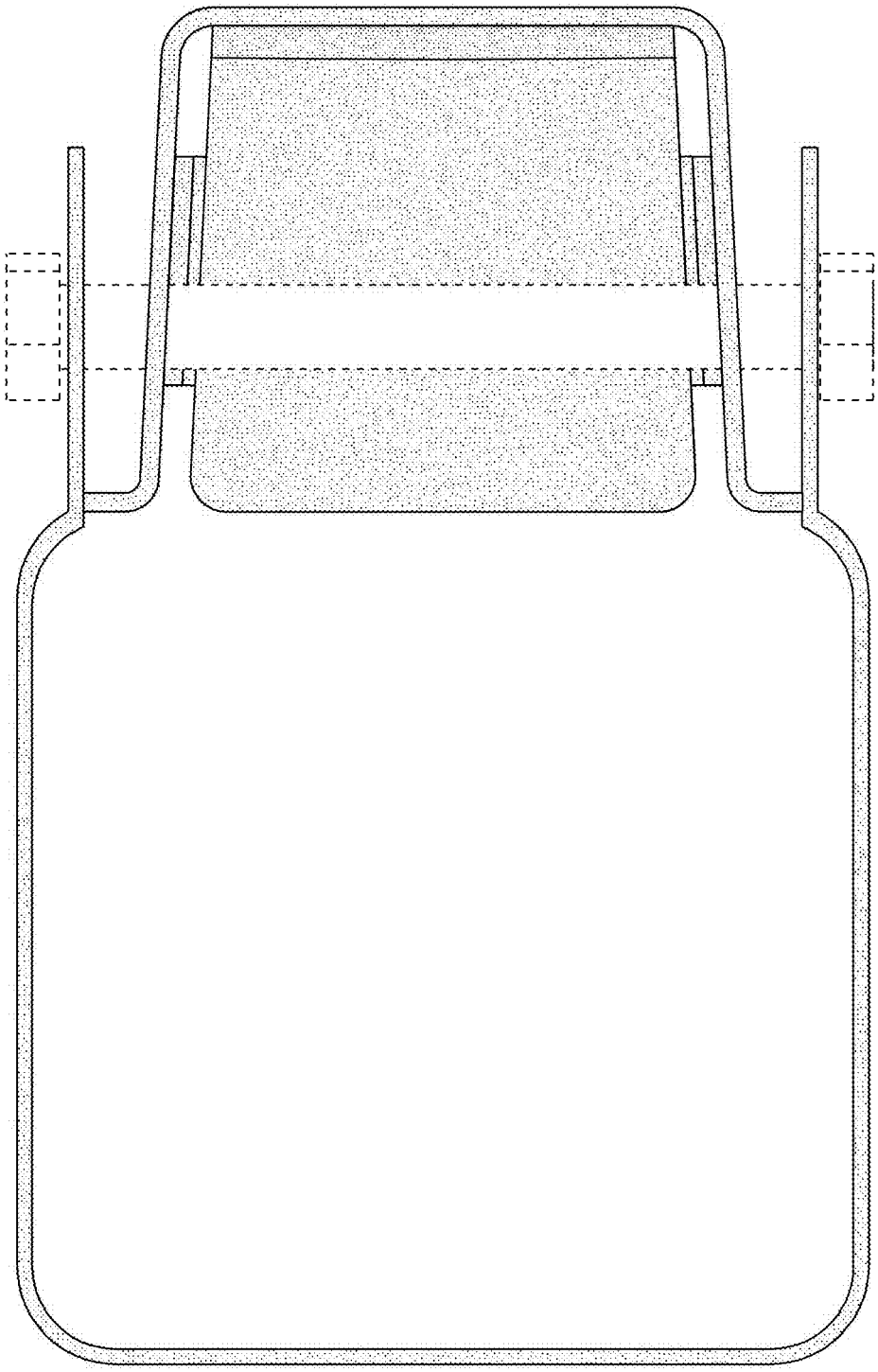

As shown in FIG. 32, the fastener comprises a threaded fastener or bolt 76 and another threaded fastener or nut 78. As shown in FIG. 37, the first opening 73 of the left sidewall is aligned with the third opening 48, the second opening 74 of the right sidewall is aligned with the fourth opening 50, and the bolt passes through and is inside the first opening, second opening, third opening and fourth opening, and the nut is threaded onto the non-head end of the bolt at the third opening or the fourth opening. The first or second opening may comprise a square opening and the bolt may comprise a carriage bolt that is non-rotatably retained at the square opening by a corresponding square shape at the head of the bolt. The opposite (threaded) end of the bolt extends from the opposite side of the strap, whereby the threaded nut is threaded onto the end of the bolt to retain the bolt and the strap at the box structure. It is noted the designated of which opening is the first, second, third or fourth opening may be interchangeable. Each of the openings may also be different shapes without departing from the scope of the present invention. By way of example, the first opening, second opening, third opening, fourth opening, fifth opening and sixth opening may be square, rectangular, circular and/or oval shaped. The bracket may also be of different widths.

The bracket is wrapped around a fence post 5 and either the wide bracket (as depicted in FIGS. 6-9) or the narrow bracket (as depicted in FIGS. 10-13) is at the other side of the fence post and receives or is joined with the first flat portion 44 with the third opening 48 and the second flat portion 46 with the fourth opening 50. With reference to FIGS. 6-9, the box structure 70 is a box shape between the left side 62 and the right side 64 and has a cross beam opening 72 for receipt of a cross beam 2. The cross beam openings are formed through the sidewalls 62, 64 and partially through the center wall 61 of the box structure to allow for adjustment of the cross beam(s) received in and through the openings. The fastener may be inserted through the aligned openings on each side to retain the rounded strap portion 40 attached to the narrow bracket or wide bracket around a fence post.

Figure 3:
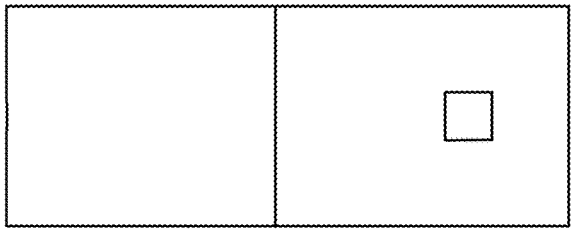
FIG. 3 is a side view of the strap bracket.
Figure 2:
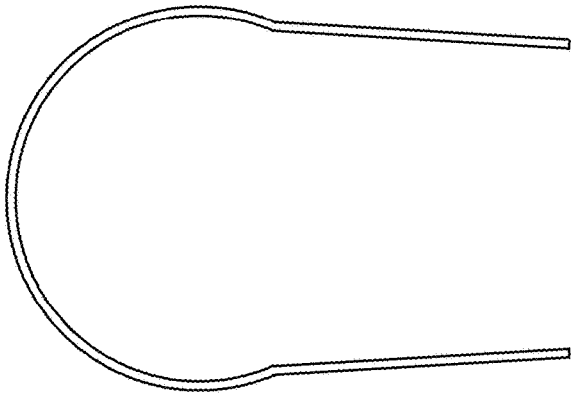
FIG. 2 is a top view of a strap bracket according to one embodiment of the present disclosure.
Figure 5:
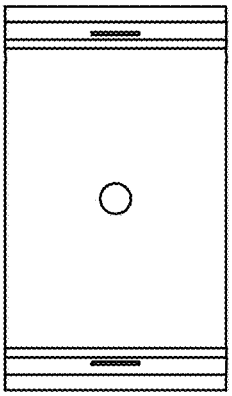
FIG. 5 is a top view of the strap bracket.
Figure 4:
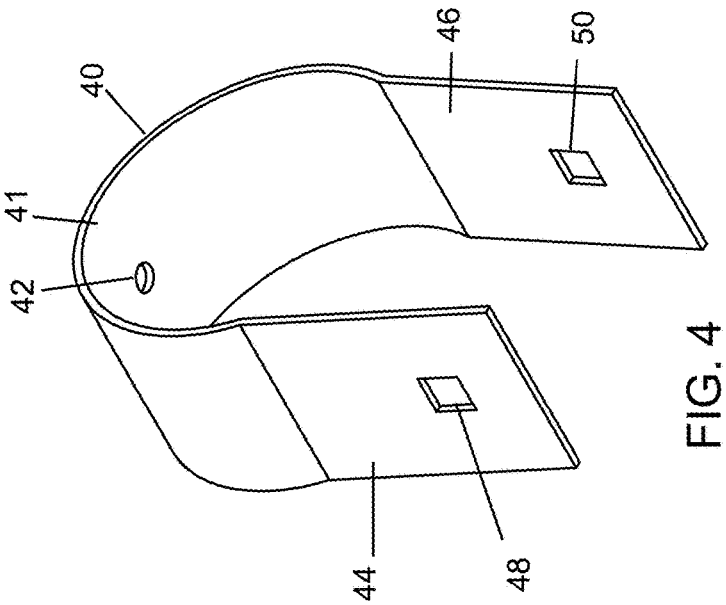
FIG. 4 is a perspective view of the strap bracket.
Figure 7:
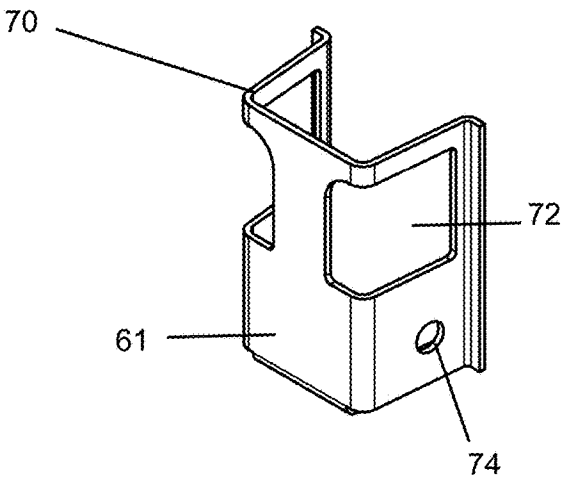
FIG. 7 is a perspective view of the wide retrofit bracket.
Figure 9:
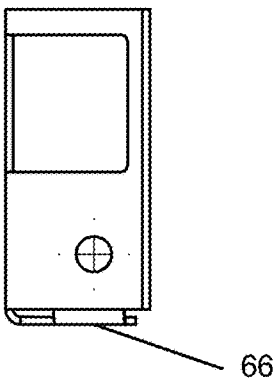
FIG. 9 is a side view of the wide retrofit bracket.

The cross beam opening may be, for example, a substantially square shaped cross beam opening and/or a substantially rectangular shaped cross beam opening. The cross beam may be a hollow cross beam (such as described in U.S. Pat. No. 10,221,586, which is hereby incorporated herein by reference in its entirety. FIG. 3 of U.S. Pat. No. 10,221,586 depicts that a single bracket may be used for any post diameter, such as 2+⅜, 4 and 6+⅝ (or any other diameter), while FIG. 4 of U.S. Pat. No. 10,221,586 depicts the partially relieved hem, as may be required to fit corner case at 4 inch diameter. FIGS. 3 and 4 of U.S. Pat. No. 10,221,586 depict the bracket and how the return flange braces against the post). The square and/or rectangular shape allows for increased strength and support and ease of installation. It also prevents buckling of the fence panel.

The fence post thus may be clamped to the bracket by the strap and support flange and by tightening the fastener to draw the sides of the bracket toward the box structure and toward one another to tighten the strap around the post. The brackets thus attach at the posts with the aligned cross beam openings spaced from the posts so that a continuous length cross beam may be inserted into and through the openings of multiple brackets (at multiple posts). The brackets thus allow for removing panels of an existing fence and, using the existing posts, replacing the fence with any desired or suitable panels that may provide enhanced security or different appearances. The fencing assembly and system thus places the rail and post in a compression fit, and allows the rail to adjust relative to the post, which may allow for changes in grade. Thus, for a fence having a plurality of fixed posts, the panel or mesh of the existing fence can be removed and the brackets can be readily mounted to the existing posts (such as a bracket at the lower part of the post and a bracket at an upper part of the post) and the cross beams may be inserted through the openings to provide a new fence structure (adjacent to the posts and not interrupted by the posts) that can provide the desired or suitable or appropriate appearance or security function.

According to another embodiment, the fencing bracket is provided with a rectangular middle portion. The bracket is depicted in FIGS. 14-29 and 39-47. The box structure comprises a bent elongated plate having a substantially planar central wall having opposing left 162 and right sidewalls 164 extending from opposing longitudinal ends thereof, and a return support flange 166 disposed at a lower edge of the plate. The left sidewall 162 includes a left side hem 167 disposed along a longitudinal edge thereof, and the right sidewall 164 includes a right side hem 168 disposed along a longitudinal edge thereof. The left and right side hems are each being bent outwardly along each respective sidewall edge forming a U-shaped cross-section, and the left sidewall and the right sidewall have a pair of aligned cross beam openings 172, wherein the opposing left and right sidewalls have a first opening and a second opening respectively. It is noted that the left side is depicted on the right side in FIG. 27, as the bracket is flipped upside down to depict the parts.

As shown in FIG. 14, the strap has a first flat portion 144 having a third opening 148, a rectangular middle portion 140 which may have an opening 142 and a second flat portion 146 having a fourth opening 150, wherein the rectangular middle portion 140 is between the first flat portion 144 and the second flat portion 146. The fastener comprises a threaded fastener or bolt 176 and another threaded fastener or nut 178. The first opening of the left sidewall is aligned with the third opening, the second opening of the right sidewall is aligned with the fourth opening, and the bolt passes through and is inside the first opening, second opening, third opening and fourth opening and is retained via the nut at the threaded end of the bolt at one of the third opening or the fourth opening.

There may be a third opening 142 in the rectangular middle portion. A screw may be inserted into the third opening 142 to engage (or thread into) the post to provide additional stability. As described above, the return support flange may have a rounded edge that may be sized to receive a corresponding size fence post. The fence post may be square, rectangular or round or a combination thereof. The pair of aligned cross beam openings accept a cross beam therein and the fence panel is attached to the cross beam. A threaded fastener may go through the fence panel and a fifth opening in the cross beam. There may be a diamond clip with a sixth opening, wherein the threaded faster goes through the sixth opening. Each of the openings (first opening, second opening, third opening, fourth opening, fifth opening and sixth opening) may be different shapes including square, rectangular, circular and oval.

One of the advantages of the fencing system is that one of the rail posts may be a corner post and two cross beam openings may be provided offset on the corner post to provide the cross beams that are inserted in the cross beam openings as offset corner posts. It is also envisioned that the cross beam openings may be offset to accommodate any shape fence, not only a corner. In many applications, a fence may not run a straight line, but forms a curve. The insertion and retention of such offset posts at the brackets is adaptable or flexible to allow a myriad of fencing shapes.

The fence panel 3 may be made of any type of material, thereby allowing a user to customize the system to defend against a wide array of threats. In one embodiment, the fence panel 3 is made of metal, and may be configured to include anti-climb, anti-cut, and many other architectural appearances. In particular embodiments, the posts 5 may be spaced apart in such a manner as to accommodate a mesh panel having a given dimension. For example, if the mesh panel has a dimension of 8×12 ft., the posts may be separated by 8 feet to snugly accommodate the mesh panel 18. Such larger mesh panels help to eliminate seams, unsightly hardware, and reduce installation time.

The fence posts 5 may be typically a solid structure, preferably made of metal for strength, stability, and durability. On the other hand, the cross beam 2 may be a hollow or partially-open structure, preferably of metal and containing a plurality of pre-formed holes to facilitate bolting of a fence panel. In some embodiments, the cross beam 2 rail member may be made of a non-conductive material such as, for example, pultruded reinforced plastic. In different embodiments, the rail members may be of different shapes, thickness, and sizes.

The fencing assembly provides great reduction in the time required to install the fence. Because roughly one third of the entire cost of a fence can be in the installation, any time reduction can equate to substantial savings. The retrofit application also removes the need to pour concrete, as existing rail posts are utilized. This results in savings to the time required, as well as eliminating the need to purchase the rail posts. As mentioned above, the rail design may eliminate many of the cuts, clamps, and connections that are necessary when installing most traditional fences. In some embodiments, the cross beam may be roll formed and may have a highly engineered shape, making it stronger and lighter than traditional rails. The engineered and pre-punched holes may allow for easy attachment of a fence panel, such as the fence panel in FIG. 1. On the other hand, in the traditional fences, attaching a mesh to the rails can be difficult using fittings due to the sheer number of fasteners/bolts to secure. The cross beams may tie the entire perimeter security system together stretching the entire length of the fence, thereby not allowing a weak joint in the fence. This may create a continuous curtain wall (utilizing existing fence posts that previously had supported an interrupted set of panels), greatly improving the structural integrity and ability to absorb impact. The cross beams may create a unitized fence line, which, when impacted, may disburse the force to the adjacent posts down the line, making the fence stronger. Because of their hollow construction, the cross beams may be utilized to run impact, electric, and/or fiber optic cables throughout the fence.

It is noted here that the square or rectangular posts as per teachings of the present disclosure may utilize flat top caps, adding to the engineered appearance of the barrier. Furthermore, the modular approach to fence construction as per teachings of the present disclosure permits easy attachment of detection devices—such as surveillance cameras or security lights—to the flat surfaces of rectangular or square posts. Also, the posts may be easily extended to incorporate such detection devices into the fence design.

As part of the anchoring step, one or more of the following ancillary or preparatory tasks may be performed, such as, for example: (i) confirming the layout of the eventual fence with appropriate utility company/companies; (ii) completing any grubbing and site preparation; (iii) staking out the layout for the fence and locating corner, end, and gate posts; (iv) digging a terminal post hole that meets the utilities specifications for size and depth; (v) marking locations for other post holes; (vi) stretching a string at a position to set the height of the posts above the grade; (vii) marking (with a marker or crayon) the posts with the depth of embedment plus the height of the string from grade, thereby allowing for the top line of the fence to be consistent; (viii) filling the post hole with concrete, tamping the post into concrete, and checking the distance from post to post; (ix) making sure that the openings in the posts are in the direction of the rails; (x) allowing a post to set at line on post matching with the string height; and (xi) surrounding the posts with concrete in a continuous pour, trowel-finishing around the posts and sloping it downward to direct water away. It is noted here that, as a general rule, the post hole size may be as per the ASTM A567 specification, where the acronym "ASTM" refers to "American Society for Testing and Materials." Thus, for example, the diameter of the post hole may be four times the diameter of the post, and the depth of the hole may be 24 inches plus 3 inches for each 1-foot increase in the height of the fence over four (4) feet. An eight (8) feet fence may generally require 36-inch embedment in concrete.

As discussed before, the cross beam may be slidably inserted. In particular embodiments, fence panels may be connected to the rails using 1⅝" hot dip galvanized carriage bolts and corresponding metallic plate and nut. The fence panels fit in-between posts. In some embodiments, a long, round-shank screw driver may be used to gain leverage in moving fence panels up as needed to maintain the top line of the fence parallel to the grade. All nuts may be hand tightened. In particular embodiments, the outermost attachment points for mesh to rails may utilize a break-away nut to prevent easy removal and unwanted access.

The fencing assembly may further comprise a finish plate to be placed over the slotted post and having a plurality of pre-drilled holes for attaching the finish plate to the slotted post. The finish plate may be made of metal. The finish plate may be directly bolted to a fence panel. The finish plates may be connected to the posts and mesh panels. In certain embodiments, each type of post—line, end, corner, and gate post—may receive a finish plate. As mentioned before, finish plates may be pre-drilled to assist in locating fastening points. In connecting a finish plate to a post, the top of the plate may be aligned with the top of the post and tamper proof ¼"×1" TEK® screws may be used in certain embodiments to secure the finish plate true and plumb to the post. TEK® screws drill their own hole and then tap threads to combine two or more pieces of material. This is done with nothing more than a standard power drill motor. On the other hand, in some embodiments, the finish plates may be connected to the fence panels using ⅜"×1" hot dip galvanized carriage bolts. In particular embodiments, the splice plates may be Diamond Fasteners™. Final tightening and peening or scarfing of threads may be done after all panels have been installed. As mentioned before, properly-sized post caps may be attached to each post. Also, after the fence system is erected in place, gates and operators may be installed to manufacturer's instructions.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

Alternative embodiments of the fencing system according to inventive aspects of the present disclosure may include additional components responsible for providing additional functionality, including any of the functionality identified above and/or any functionality necessary to support the solution as per the teachings of the present disclosure. Although features and elements are described above in particular combinations, each feature or element can be used alone without the other features and elements or in various combinations with or without other features.

The foregoing describes a modular perimeter fencing system in which rail posts are used in conjunction with a bracket to accommodate different shapes, thickness, and sizes to support the fence panels in a manner that creates a unified curtain wall perimeter barrier. For additional strength, each fence panel may also be through-bolted to metallic finish plates, which are mounted on the cross beams for seamless and aesthetically-pleasing look.

Changes and modifications in the specifically described embodiments may be carried out without departing from the principles of the present invention, which is intended to be limited only by the scope of the appended claims as interpreted according to the principles of patent law.

The invention claimed is:

1. A fencing bracket, said fencing bracket comprising:

a box structure comprising (i) a bent elongated plate having a central wall and opposing left and right sidewalls extending from opposing longitudinal ends of the central wall, and (ii) a return support flange disposed at a lower edge of the box structure, wherein the left sidewall and the right sidewall have aligned cross beam openings configured to receive a crossbeam, and wherein the opposing left and right sidewalls have a first opening and a second opening, respectively:

wherein the left sidewall has a left side hem disposed along a longitudinal edge thereof and the right sidewall has a right side hem disposed along a longitudinal edge thereof, and wherein the left side hem and the right side hem are each bent outwardly along the respective sidewall edge forming a respective L-shaped cross-section;

a strap having a first flat portion having a third opening, a rounded middle portion and a second flat portion having a fourth opening, wherein the rounded middle portion is between the first flat portion and the second flat portion; wherein the strap is attached at the box structure, and wherein the strap and the return support flange are configured to engage a fence post that is received in the fencing bracket;

wherein the first and second flat portions of the strap engage the left side hem and the right side hem with a gap between the first and second flat portions and the left and right sidewalls of the box structure;

a fastener;

wherein the first opening of the left side wall is aligned with the third opening, the second opening of the right side wall is aligned with the fourth opening, the fastener passes through the first opening, second opening, third opening and fourth opening and is retained via another fastener at the third opening or the fourth opening;

wherein the fastener, when tightened, retains the first and second flat portions at the left and right sidewalls to clamp the post within and between the strap and return support flange of the box structure; and wherein a passageway extending between the crossbeam openings is parallel to a passageway extending between the first opening, the second opening, the third opening and the fourth opening.

2. A fencing bracket as in claim 1, wherein the rounded middle portion further comprises a fifth opening.

3. A fencing bracket as in claim 1, wherein the return support flange has a rounded edge.

4. A fencing bracket as in claim 3, wherein the rounded edge is sized to receive a corresponding size fence post.

5. A fencing bracket as in claim 4, wherein the fence post is round.

6. A fencing bracket as in claim 1, wherein, with the cross beam accepted within the aligned cross beam openings, a fence panel is attached to the cross beam.

7. A fencing bracket as in claim 6, wherein the passageway extending between the cross beam openings is spaced from a passageway defined by the strap and the return support flange.

8. A fencing bracket as in claim 6, further comprising a threaded fastener, and wherein, with the cross beam accepted within the aligned cross beam openings, the threaded fastener extends through the fence panel and a fifth opening in the cross beam.

9. A fencing bracket as in claim 8, further comprising a diamond clip with a sixth opening, wherein, with the cross beam accepted within the aligned cross beam openings, the threaded fastener extends through the sixth opening.

10. A fencing bracket as in claim 9, wherein the first opening, second opening, third opening, fourth opening, fifth opening and sixth opening are a shape selected from the group consisting of a square shape, a rectangular shape, a circular shape and an oval shape.

11. A fencing bracket as in claim 1, wherein the central wall of the bent elongated plate comprises a planar central wall.

12. A fencing bracket as in claim 1, wherein the fastener comprises a bolt and the other fastener comprises a nut that threadedly attaches at an end of the bolt.

13. A fencing bracket, said fencing bracket comprising:

a box structure comprising (i) a bent elongated plate having a central wall and opposing left and right sidewalls extending from opposing longitudinal ends of the central wall, and (ii) a return support flange disposed at a lower edge of the box structure, wherein the left sidewall and the right sidewall have aligned cross beam openings configured to receive a crossbeam, and wherein the opposing left and right sidewalls have a first opening and a second opening, respectively;

wherein the left sidewall has a left side hem disposed along a longitudinal edge thereof and the right sidewall has a right side hem disposed along a longitudinal edge thereof, and wherein the left side hem and the right side hem are each bent outwardly along the respective sidewall edge forming a respective L-shaped cross-section;

a strap having a first flat portion having a third opening, a rectangular riddle portion and a second flat portion having a fourth opening, wherein the rectangular middle portion is between the first flat portion and the second flat portion;

wherein the strap is attached at the box structure, and wherein the strap and the return support flange are configured to engage a fence post that is received in the fencing bracket;

wherein the first and second flat portions of the strap engage the left side hem and the right side hem with a gap between the first and second flat portions and the left and right sidewalls of the box structure;

a fastener:

wherein the first opening of the left side wall is aligned with the third opening, the second opening of the right side wall is aligned with the fourth opening, the fastener passes through the first opening, second opening, third opening and fourth opening and is retained via another fastener at the third opening or the fourth opening;

wherein the fastener, when tightened, retains the first and second flat portions at the left and right sidewalls to clamp the post within and between the strap and return support flange of the box structure; and wherein a passageway extending between the crossbeam openings is parallel to a passageway extending between the first opening, the second opening, the third opening and the fourth opening.

14. A fencing bracket as in claim 13, wherein the rectangular middle portion comprises a fifth opening.

15. A fencing bracket as in claim 13, wherein the return support flange has a rounded edge.

16. A fencing bracket as in claim 15, wherein the rounded edge is sized to receive a corresponding size fence post.

17. A fencing bracket as in claim 16, wherein the fence post is round.

18. A fencing bracket as in claim 13, wherein, with the cross beam accepted within the aligned cross beam openings, a fence panel is attached to the cross beam.

19. A fencing bracket as in claim 18, wherein the passageway extending between the cross beam openings is spaced from a passageway defined by the strap and the return support flange.

20. A fencing bracket as in claim 18, further comprising a threaded fastener, and wherein, with the cross beam accepted within the aligned cross beam openings, the threaded fastener extends through the fence panel and a fifth opening in the cross beam.

21. A fencing bracket as in claim 20, further comprising a diamond clip with a sixth opening, wherein, with the cross beam accepted within the aligned cross beam openings, the threaded fastener extends through the sixth opening.

22. A fencing bracket as in claim 21, wherein the first opening, second opening, third opening, fourth opening, fifth opening and sixth opening are a shape selected from the group consisting of a square shape, a rectangular shape, a circular shape and an oval shape.

23. A fencing bracket as in claim 13, wherein the central wall of the bent elongated plate comprises a planar central wall.

24. A fencing bracket as in claim 13, wherein the fastener comprises a bolt and the other fastener comprises a nut that threadedly attaches at an end of the bolt.

* * * * *